US011613138B2

(12) United States Patent
Kida et al.

(10) Patent No.: US 11,613,138 B2
(45) Date of Patent: Mar. 28, 2023

(54) PRINTING APPARATUS

(71) Applicant: CANON KABUSHIKI KAISHA, Tokyo (JP)

(72) Inventors: Akira Kida, Yokohama (JP); Hideaki Nagahara, Yokohama (JP); Hiroyuki Saito, Machida (JP); Takao Kawai, Tokyo (JP); Nanae Uchinuno, Tokyo (JP); Toshimitsu Takahashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/348,167

(22) Filed: Jun. 15, 2021

(65) Prior Publication Data

US 2021/0309031 A1 Oct. 7, 2021

Related U.S. Application Data

(63) Continuation of application No. 16/526,957, filed on Jul. 30, 2019, now Pat. No. 11,072,195.

(30) Foreign Application Priority Data

Aug. 10, 2018 (JP) ..... JP2018-151457

(51) Int. Cl.
*B41J 29/377* (2006.01)
*B41J 2/175* (2006.01)
(Continued)

(52) U.S. Cl.
CPC ..... *B41J 29/377* (2013.01); *B41J 2/04501* (2013.01); *B41J 2/17596* (2013.01);
(Continued)

(58) Field of Classification Search
None
See application file for complete search history.

(56) References Cited

U.S. PATENT DOCUMENTS 5,619,237 A 4/1997 Inoue et al. ..... 347/86
5,621,450 A 4/1997 Kawai et al. ..... 347/108
(Continued)

FOREIGN PATENT DOCUMENTS

JP H06-155765 6/1994
JP 2003-154727 5/2003
(Continued)

OTHER PUBLICATIONS

Office Action dated May 24, 2022 in counterpart Japanese Application No. 2018-151457, together with English translation thereof.

*Primary Examiner* — Justin Seo
(74) *Attorney, Agent, or Firm* — Venable LLP

(57) ABSTRACT

A printing apparatus includes: a tank configured to contain ink; a print head configured to eject ink supplied from the tank; a supply flow path through which liquid is supplied from the tank to the print head; a collection flow path through which liquid is collected from the print head to the tank; a circulation unit configured to circulate ink inside a circulation flow path including the tank, the supply flow path, the print head, and the collection flow path; and a cooling unit configured to cool the tank by blowing.

19 Claims, 17 Drawing Sheets

(51) Int. Cl.
*B41J 2/045* (2006.01)
*B41J 29/13* (2006.01)
*B41J 2/18* (2006.01)

(52) U.S. Cl.
CPC ..... *B41J 2/18* (2013.01); *B41J 29/13* (2013.01); *B41J 2202/20* (2013.01)

(56) References Cited

U.S. PATENT DOCUMENTS

| | | | | |
|---|---|---|---|---|
| 5,717,445 | A | 2/1998 | Kida et al. | 347/33 |
| 5,751,301 | A | 5/1998 | Saikawa et al. | 347/8 |
| 5,933,174 | A | 8/1999 | Kawazoe et al. | 347/85 |
| 6,062,683 | A | 5/2000 | Kawakami et al. | 347/87 |
| 6,095,635 | A | 8/2000 | Kinoshita et al. | 347/36 |
| 6,113,215 | A | 9/2000 | Yanagi et al. | 347/49 |
| 6,120,128 | A | 9/2000 | Kawakami et al. | 347/37 |
| 6,336,709 | B1 | 1/2002 | Inoue et al. | 347/49 |
| 6,361,158 | B1 | 3/2002 | Inoue et al. | 347/86 |
| 6,536,885 | B2 | 3/2003 | Kuribayashi et al. | 347/85 |
| 7,401,909 | B2 | 7/2008 | Inoue et al. | 347/86 |
| 7,407,274 | B2 | 8/2008 | Inoue et al. | 347/86 |
| 7,407,275 | B2 | 8/2008 | Inoue et al. | 347/86 |
| 7,914,137 | B2 | 3/2011 | Inoue et al. | 347/86 |
| 8,425,022 | B2 | 4/2013 | Inoue et al. | 347/86 |
| 9,346,300 | B2 | 5/2016 | Suzuki | B41J 2/01 |
| 2008/0204500 | A1* | 8/2008 | Umeda | B41J 29/02 347/17 |
| 2009/0213163 | A1 | 8/2009 | Bansyo | 347/17 |
| 2013/0021417 | A1* | 1/2013 | Ota | B41J 29/377 347/85 |
| 2017/0282569 | A1* | 10/2017 | Kobayashi | B41J 2/17553 |
| 2019/0047306 | A1 | 2/2019 | Sasaki | B41J 29/377 |
| 2019/0143686 | A1 | 5/2019 | Hirata et al. | 347/47 |
| 2019/0193396 | A1* | 6/2019 | Ohtsu | B41J 2/17596 |

FOREIGN PATENT DOCUMENTS

| | | |
|---|---|---|
| JP | 2004-130578 | 4/2004 |
| JP | 2007-296640 | 11/2007 |
| JP | 2009-196208 | 9/2009 |
| JP | 2014-148121 | 8/2014 |
| JP | 2017-105212 | 6/2017 |

* cited by examiner

PRINTING APPARATUS

This application is a continuation of application Ser. No. 16/526,957 filed Jul. 30, 2019, currently pending; and claims priority under 35 U.S.C. § 119 to Japan Application No. 2018-151457 filed in Japan on Aug. 10, 2018; and the contents of all of which are incorporated herein by reference as if set forth in full.

BACKGROUND OF THE INVENTION

Field of the Invention

The present invention relates to printing apparatuses.

Description of the Related Art

There are known inkjet printing apparatuses in which ink circulates between the tank and the print head. In the case where the temperature of circulating ink increases, water contained in the ink evaporates, leading to increase in the viscosity of the ink, or air inside the ink grows up to be bubbles, preventing proper ink ejection. Japanese Patent Laid-Open No. 2009-196208 (hereinafter referred to as patent document 1) discloses a technique for cooling part of circulating ink with a cooling fan disposed at a point on the circulation path.

The technique in patent document 1 is only for cooling part of circulating ink locally, and thus, is incapable of cooling the entire circulating ink efficiently.

SUMMARY OF THE INVENTION

A printing apparatus according to an aspect of the present invention includes: a tank configured to contain ink; a print head configured to eject ink supplied from the tank; a supply flow path through which liquid is supplied from the tank to the print head; a collection flow path through which liquid is collected from the print head to the tank; a circulation unit configured to circulate ink inside a circulation flow path including the tank, the supply flow path, the print head, and the collection flow path; and a cooling unit configured to cool the tank by blowing.

Further features of the present invention will become apparent from the following description of exemplary embodiments with reference to the attached drawings.

DESCRIPTION OF THE EMBODIMENTS

Figure 1:
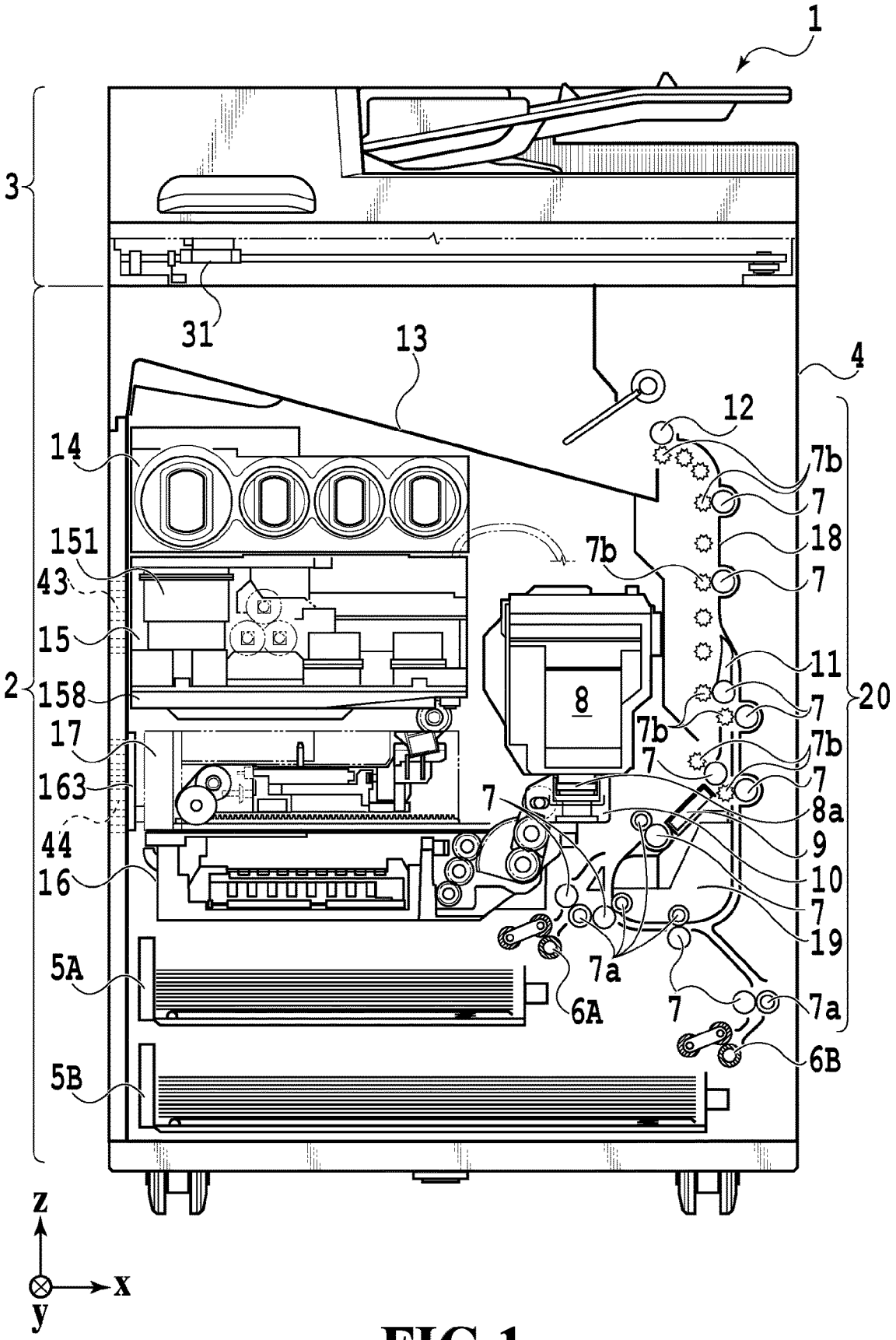
FIG. 1 is a diagram showing a printing apparatus in a standby state.

Embodiments of the present invention will be described below with reference to the drawings. It should be noted that the following embodiments do not limit the present invention and that not all of the combinations of the characteristics described in the present embodiments are essential for solving the problem to be solved by the present invention. Incidentally, the same reference numeral refers to the same component in the following descriptions. Furthermore, relative positions, shapes, and the like of the constituent elements described in the embodiments are exemplary only and are not intended to limit the scope of the invention.

First Embodiment

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction (gravitational direction).

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The scanner unit 3 is configured such that it alone can be removed from the main body of the printing apparatus. Note that in this specification, a unit being configured such that it alone can be removed means that the unit can be removed without affecting other mechanisms (parts and units). Specifically, in a case where the user removes the scanner unit 3, the user can remove the scanner unit 3 without removing other mechanisms. The scanner unit 3 can be attached or removed by sliding the scanner unit 3 in the z-direction from the top face of the apparatus. The scanner unit 3 includes a CIS 31 (contact image sensor) that scans in the x-direction to read the original document. The CIS 31 is also configured to be removable from the top face of the apparatus. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction (gravitational direction). A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 compose a conveying unit 20 for guiding a print medium S in a predetermined direction. The conveying unit 20 is configured such that it alone can be removed from the main body of the printing apparatus. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. In other words, the print head 8 is configured to be capable of ejecting ink of multiple colors. In a case where the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8. The movement of the print head 8 from the standby position to a printing position will be described later in detail. The print head 8 is configured such that it alone can be removed from the main body of the printing apparatus.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range. Each of the ink tank unit 14 and the ink supply unit 15 is configured such that it alone can be removed from the main body of the printing apparatus.

A maintenance unit 16 comprises the cap unit 10 and a wiping unit 17 and activates them at predetermined timings to perform maintenance operation for the print head 8. The maintenance unit 16 is configured such that it alone can be removed from the main body of the printing apparatus.

Figure 2:
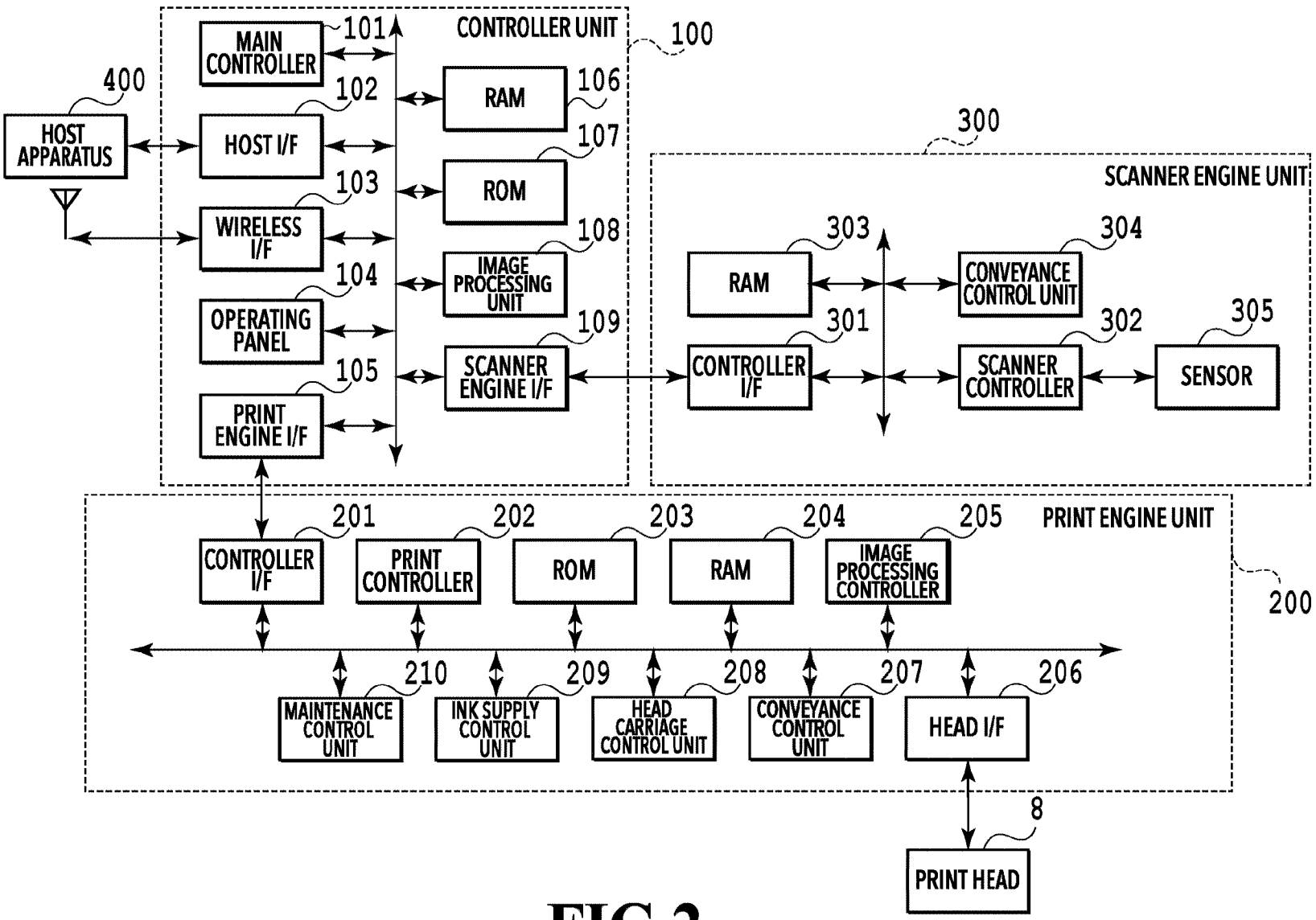
FIG. 2 is a control configuration diagram of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, in a case where a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, if a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. Once various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 at the time of performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
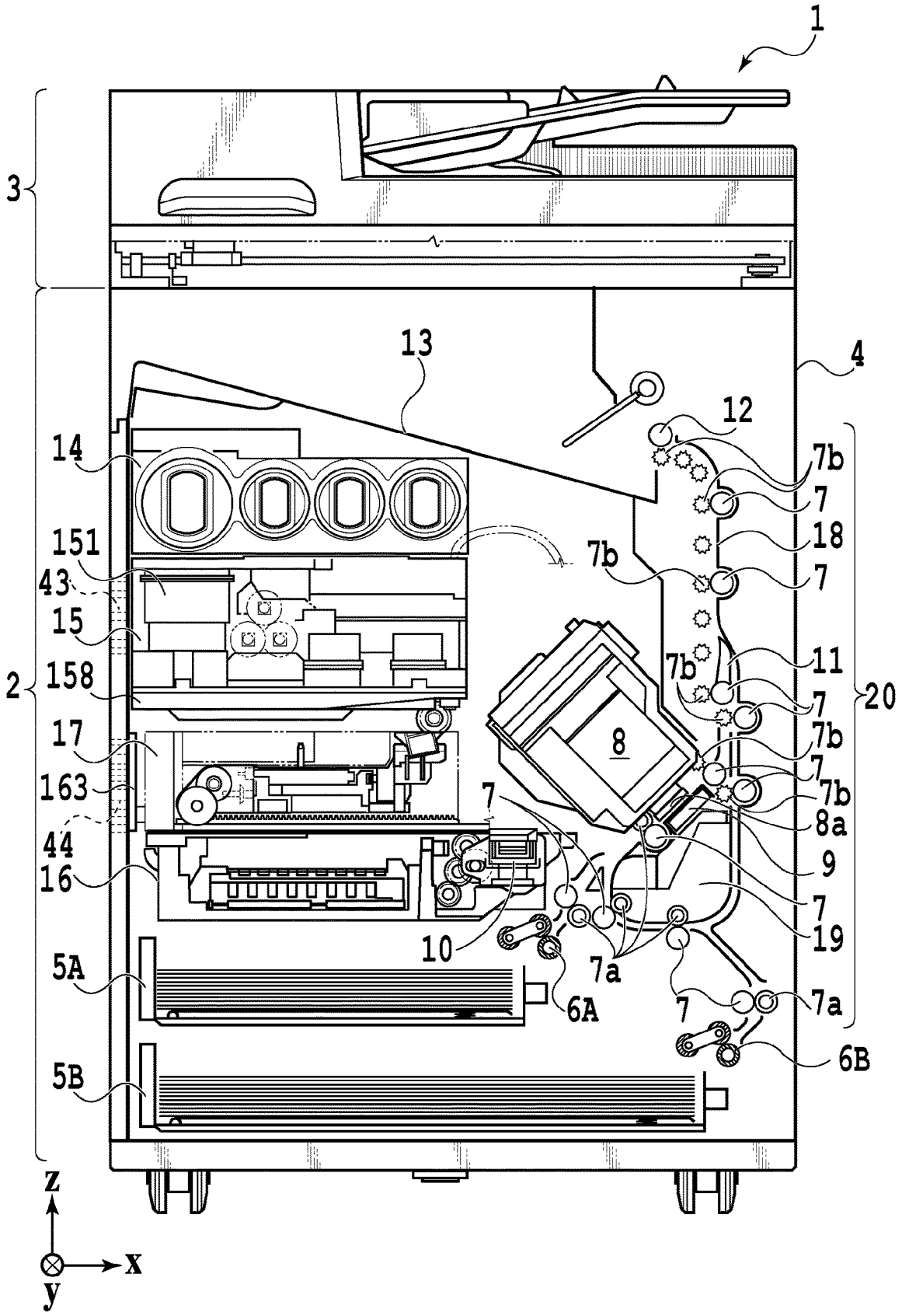
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45 degrees with respect to the horizontal plane. The ejection opening surface 8*a* of the print head 8 in a printing position is also inclined about 45 degrees with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45 degrees while adjusting the vertical height of the print head 8 such that the ejection opening surface 8*a* faces the platen 9. After the completion of print operation, the print controller 202 reverses the above procedure to move the print head 8 from the printing position to the standby position.

Figure 4:
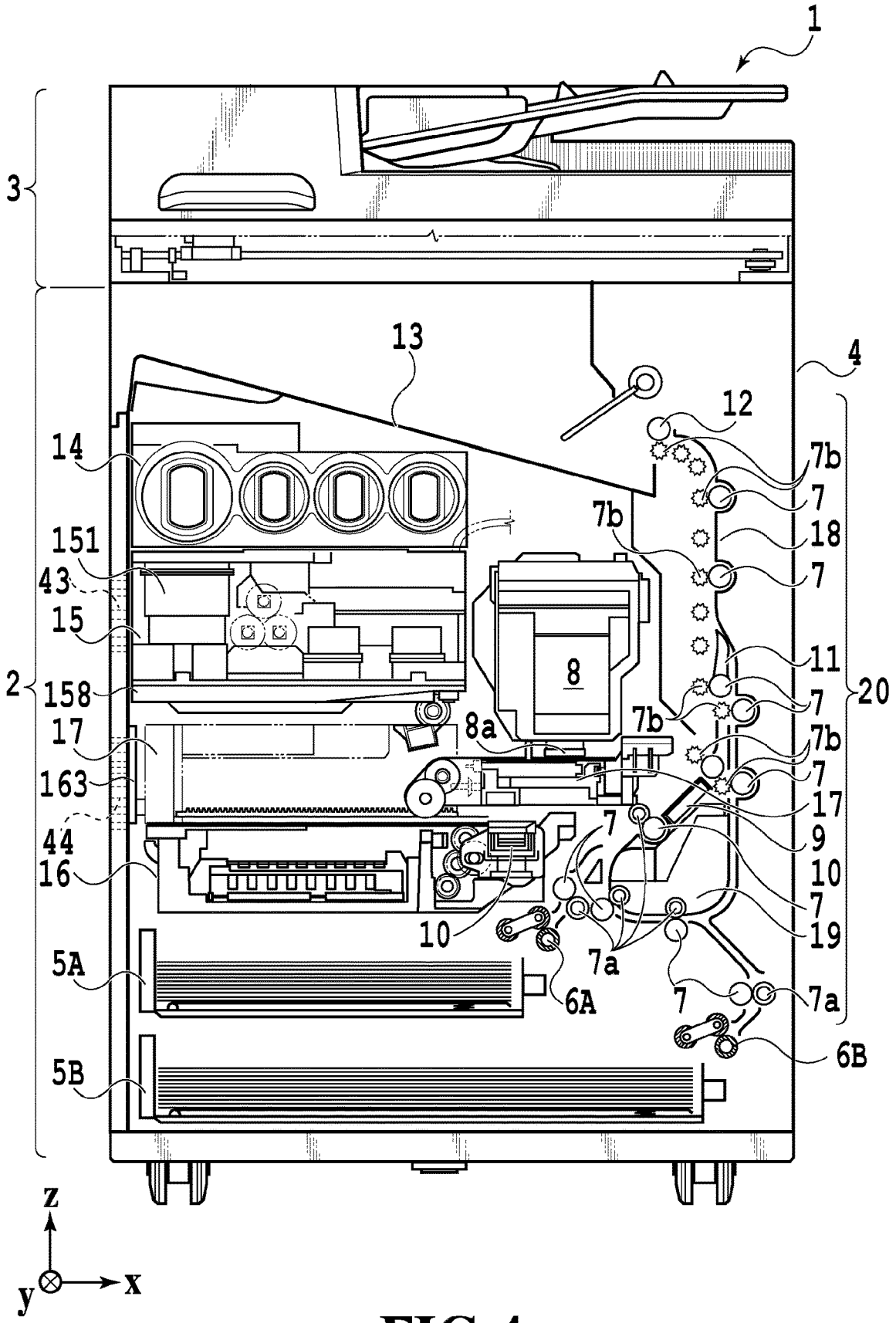
FIG. 4 is a diagram showing the printing apparatus in a maintenance state.

FIG. 4 is a diagram showing the printing apparatus 1 in a maintenance state. In the case of moving the print head 8 from the standby position shown in FIG. 1 to a maintenance position shown in FIG. 4, the print controller 202 moves the print head 8 vertically upward and moves the cap unit 10 vertically downward. The print controller 202 then moves the wiping unit 17 from the evacuation position to the right in FIG. 4. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 4, the print controller 202 moves the print head 8 vertically upward while turning it 45 degrees. The print controller 202 then moves the wiping unit 17 from the evacuation position to the right. Following that, the print controller 202 moves the print head 8 vertically downward to the maintenance position where maintenance operation can be performed by the maintenance unit 16.

(Maintenance Unit)

Figure 5A:
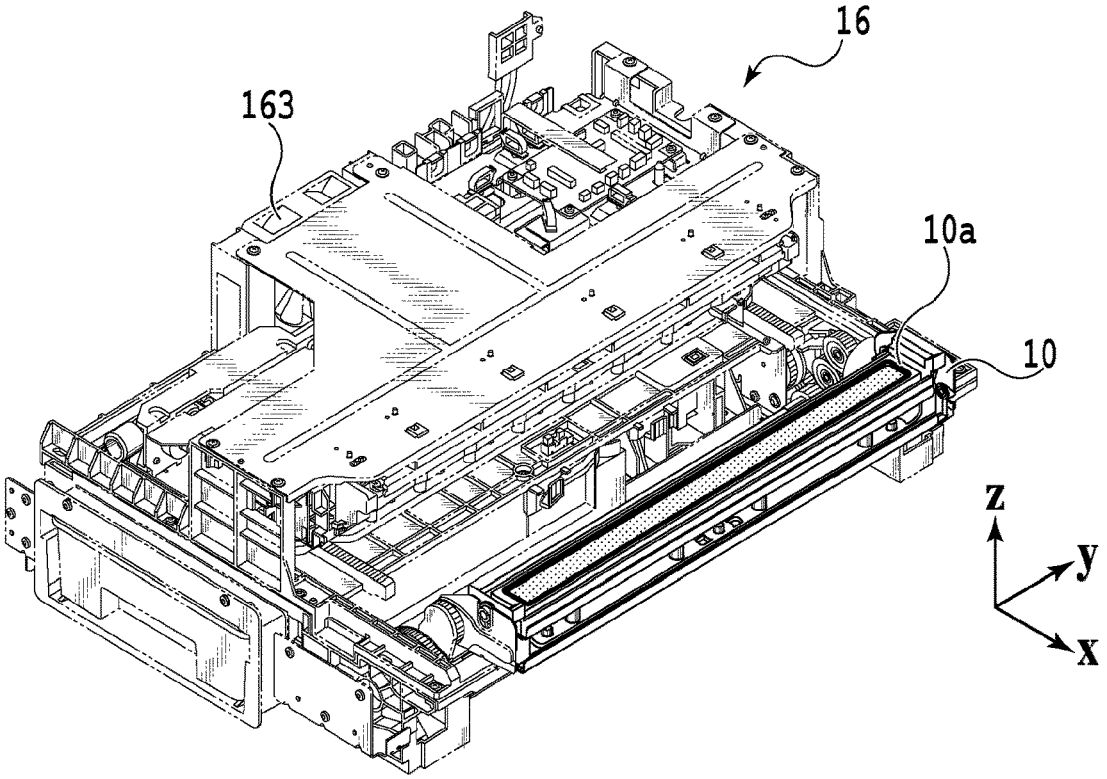
FIGS. 5A and 5B are perspective views showing the configuration of a maintenance unit.
Figure 5B:
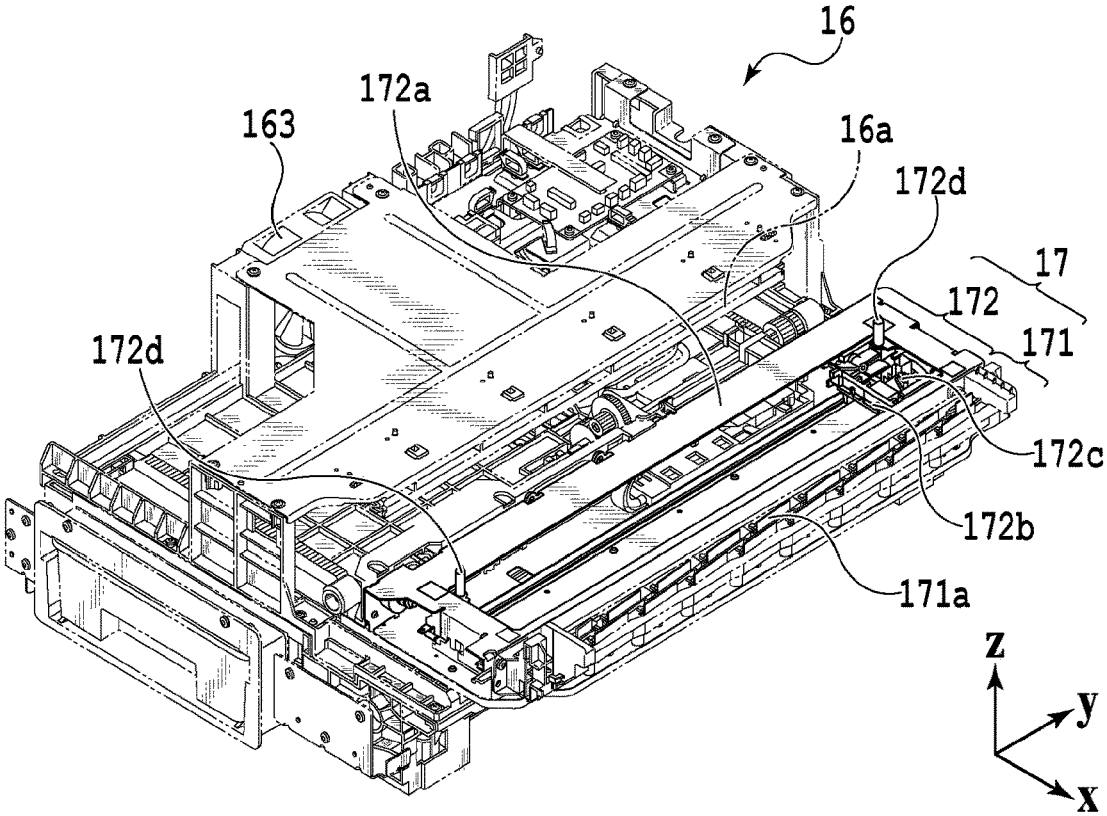

FIG. 5A is a perspective view showing the maintenance unit 16 in a standby position. FIG. 5B is a perspective view showing the maintenance unit 16 in a maintenance position. FIG. 5A corresponds to FIG. 1 and FIG. 5B corresponds to FIG. 4. When the print head 8 is in the standby position, the maintenance unit 16 is in the standby position shown in FIG. 5A, the cap unit 10 has been moved vertically upward, and the wiping unit 17 is housed in the maintenance unit 16. The cap unit 10 comprises a box-shaped cap member 10*a* extending in the y-direction. The cap member 10*a* can be brought into intimate contact with the ejection opening surface 8*a* of the print head 8 to prevent ink from evaporating from the ejection openings. The cap unit 10 also has the function of collecting ink ejected to the cap member 10*a* for preliminary ejection or the like and allowing a suction pump (not shown) to suck the collected ink. The maintenance unit 16 includes an air discharge fan 163. The air discharge fan 163 will be described later.

On the other hand, in the maintenance position shown in FIG. 5B, the cap unit 10 has been moved vertically downward and the wiping unit 17 has been drawn from the maintenance unit 16. The wiping unit 17 comprises two wiper units: a blade wiper unit 171 and a vacuum wiper unit 172.

In the blade wiper unit 171, blade wipers 171*a* for wiping the ejection opening surface 8*a* in the x-direction are provided in the y-direction by the length of an area where the ejection openings are arrayed. In the case of performing wiping operation by the use of the blade wiper unit 171, the wiping unit 17 moves the blade wiper unit 171 in the x-direction while the print head 8 is positioned at a height at which the print head 8 can be in contact with the blade wipers 171*a*. This movement enables the blade wipers 171*a* to wipe ink and the like adhering to the ejection opening surface 8*a*.

The entrance of the maintenance unit 16 through which the blade wipers 171*a* are housed is equipped with a wet wiper cleaner 16*a* for removing ink or the like adhering to the blade wipers 171*a* and applying a wetting liquid to the blade wipers 171*a*. The wet wiper cleaner 16*a* removes substances adhering to the blade wipers 171*a* and applies the wetting liquid to the blade wipers 171*a* each time the blade wipers 171*a* are inserted into the maintenance unit 16. The wetting liquid is transferred to the ejection opening surface 8*a* in the next wiping operation for the ejection opening surface 8*a*, thereby facilitating sliding between the ejection opening surface 8*a* and the blade wipers 171*a*.

The vacuum wiper unit 172 comprises a flat plate 172*a* having an opening extending in the y-direction, a carriage 172*b* movable in the y-direction within the opening, and a vacuum wiper 172*c* mounted on the carriage 172*b*. The vacuum wiper 172*c* is provided to wipe the ejection opening surface 8*a* in the y-direction along with the movement of the carriage 172*b*. The tip of the vacuum wiper 172*c* has a suction opening connected to the suction pump (not shown). Accordingly, if the carriage 172*b* is moved in the y-direction while operating the suction pump, ink and the like adhering to the ejection opening surface 8*a* of the print head 8 are wiped and gathered by the vacuum wiper 172*c* and sucked into the suction opening. At this time, the flat plate 172*a* and a dowel pin 172*d* provided at both ends of the opening are used to align the ejection opening surface 8*a* with the vacuum wiper 172*c*.

(Ink Supply Unit (Ink Circulation System))

Figure 6:
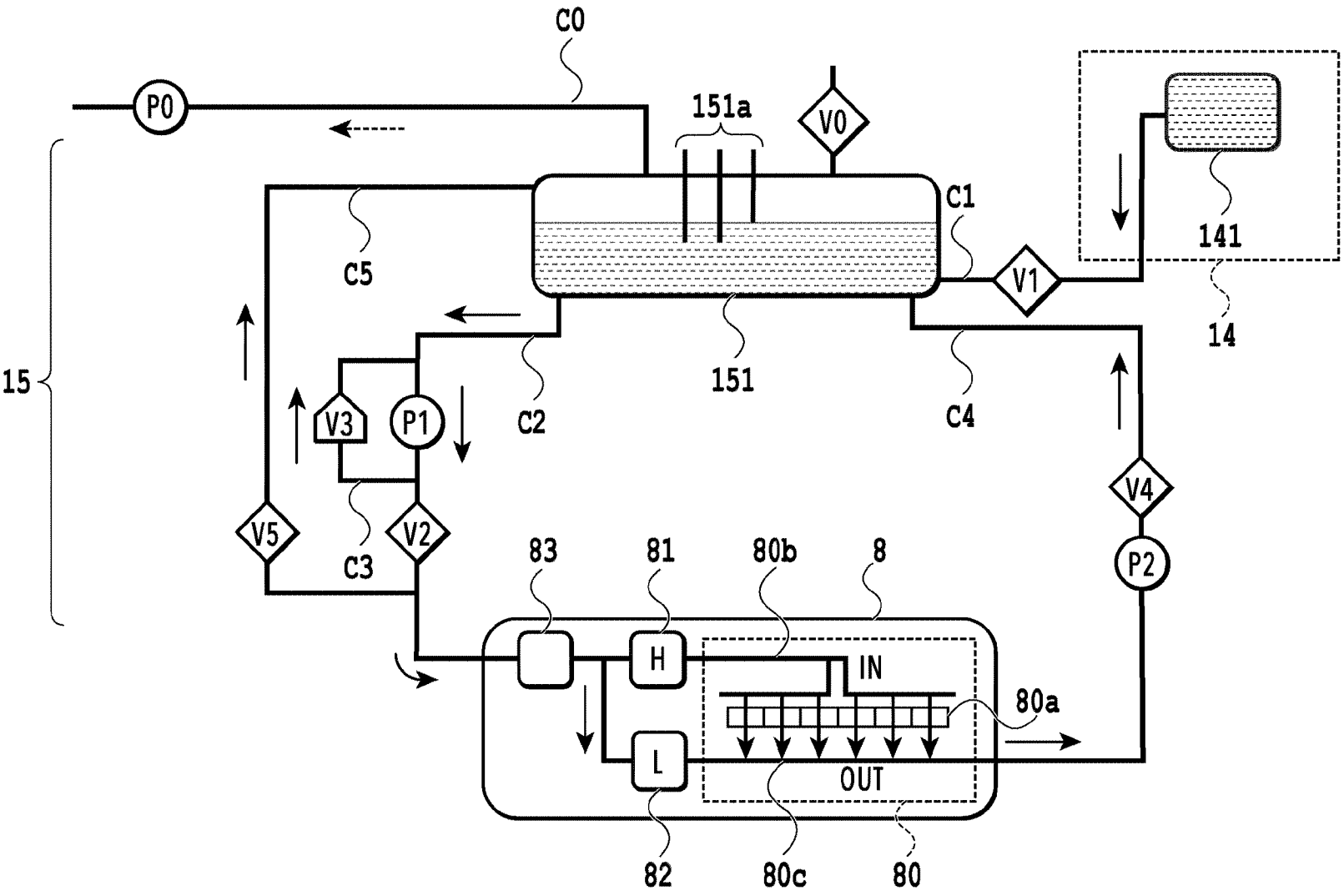
FIG. 6 is a diagram illustrating a flow path configuration of an ink circulation system.

FIG. 6 is a diagram including the ink supply unit 15 adopted in the inkjet printing apparatus 1 of the present embodiment. With reference of FIG. 6, a flow path configuration of an ink circulation system of the present embodiment will be described. The ink supply unit 15 supplies ink supplied from the ink tank unit 14 to the print head 8 (head unit). Although FIG. 6 shows a configuration for one color ink, such a configuration is practically prepared for each color ink. The ink supply unit 15 is basically controlled by the ink supply control unit 209 shown in FIG. 2. The following will describe the configuration of each component of the ink supply unit 15.

Ink is circulated mainly between a sub-tank 151 and the print head 8. In the print head 8, ink ejection operation is performed based on image data and ink that has not been ejected is collected back into the sub-tank 151.

The sub-tank 151 in which a certain amount of ink is contained is connected to a supply flow path C2 for supplying ink to the print head 8 and to a collection flow path C4 for collecting ink from the print head 8. In other words, a circulation flow path (circulation path) for circulating ink is provided by the sub-tank 151, the supply flow path C2, the print head 8, and the collection flow path C4. The sub-tank 151 is also connected to an air flow path C0 where air flows. The air flow path C0 is an atmosphere communication flow path where an atmosphere release valve V0 communicate.

A liquid level detection unit 151*a* including a plurality of electrode pins is provided in the sub-tank 151. The ink supply control unit 209 detects the presence/absence of a conducting current between those pins so as to grasp a height of an ink liquid level, that is, an amount of remaining ink inside the sub-tank 151. A vacuum pump P0 (an intratank vacuum pump) is a negative pressure generating source for reducing pressure inside the sub-tank 151. The atmosphere release valve V0 is a valve for switching between whether or not to make the inside of the sub-tank 151 communicate with atmosphere.

A main tank 141 is a tank that contains ink which is to be supplied to the sub-tank 151. The main tank 141 is configured to be detachable from the printing apparatus body. A tank supply valve V1 for switching connection between the sub-tank 151 and the main tank 141 is provided in the midstream of a tank connection flow path C1 connecting the sub-tank 151 and the main tank 141.

In a case where the liquid level detection unit 151*a* detects that the amount of ink inside the sub-tank 151 is less than a certain amount, the ink supply control unit 209 closes the atmosphere release valve V0, a supply valve V2, a collection valve V4, and a head replacement valve V5. Further, the ink supply control unit 209 opens the tank supply valve V1. In this state, the ink supply control unit 209 causes the vacuum pump P0 to operate. This sets the pressure inside the sub-tank 151 to negative so that ink is supplied from the main tank 141 to the sub-tank 151. In a case where the liquid level detection unit 151*a* detects that the amount of ink inside the sub-tank 151 exceeds the certain amount, the ink supply control unit 209 closes the tank supply valve V1, and stops the vacuum pump P0.

The supply flow path C2 is a flow path for supplying ink from the sub-tank 151 to the print head 8, and a supply pump P1 and the supply valve V2 are disposed in the midstream of the supply flow path C2. During print operation, driving the supply pump P1 in the state of the supply valve V2 being open allows ink circulation in the circulation path while supplying ink to the print head 8. The amount of ink to be ejected per unit time by the print head 8 varies according to image data. A flow rate of the supply pump P1 is determined so as to be adaptable even in a case where the print head 8 performs ejection operation in which ink consumption amount per unit time becomes maximum.

A relief flow path C3 is a flow path which is located in the upstream of the supply valve V2 and which connects between the upstream and downstream of the supply pump P1. A relief valve V3 which is a differential pressure valve is provided in the midstream of the relief flow path C3. The relief valve V3 is not opened or closed by a drive mechanism, but is urged by a spring. The relief valve V3 is configured to be opened in a case where the differential pressure reaches predetermined pressure. For example, in a case where the amount of ink supply from the supply pump P1 per unit time is larger than the total value of an ejection amount of the print head 8 per unit time and a flow rate (ink pulling-out amount) in a collection pump P2 per unit time, the relief valve V3 is released according to a pressure applied thereto. As a result, a cyclic flow path provided by a portion of the supply flow path C2 and the relief flow path C3 is formed. Providing the relief flow path C3 allows the amount of ink supply to the print head 8 to be adjusted according to the amount of ink consumed by the print head 8, thereby stabilizing the pressure inside the circulation path irrespective of image data.

The collection flow path C4 is a flow path for collecting ink from the print head 8 back to the sub-tank 151. The collection pump P2 and the collection valve V4, are disposed in the midstream of the collection flow path C4. The collection pump P2 serves as a negative pressure generating source to suck ink from the print head 8 at the time of circulating ink within the circulation path. Driving the collection pump P2 generates an appropriate differential pressure between an IN flow path 80*b* and an OUT flow path 80*c* inside the print head 8, so that ink can be circulated between the IN flow path 80*b* and the OUT flow path 80*c*.

The collection valve V4 is a valve for preventing backflow at the time of not performing print operation, that is, at the time of not circulating ink within the circulation path. In the circulation path of the present embodiment, the sub-tank 151 is disposed higher than the print head 8 in a vertical direction (see FIG. 1). As such, in a case where the supply pump P1 or the collection pump P2 is not driven, it is likely that ink flows back from the sub-tank 151 to the print head 8 due to a water head difference between the sub-tank 151 and the print head 8. In order to prevent such backflow, the collection valve V4 is provided in the collection flow path C4 in the present embodiment.

The supply valve V2 also serves as a valve for preventing ink supply from the sub-tank 151 to the print head 8 at the time of not performing print operation, that is, at the time of not circulating ink within the circulation path.

A head replacement flow path C5 is a flow path connecting the supply flow path C2 and an air chamber (space in which ink is not contained) of the sub-tank 151, with the head replacement valve V5 being disposed in the midstream of the head replacement flow path C5. One end of the head replacement flow path C5 is connected to the upstream of the print head 8 in the supply flow path C2 and to the downstream of the supply valve V2. The other end of the head replacement flow path C5 is connected to the upper part of the sub-tank 151 to communicate with the air chamber inside the sub-tank 151. The head replacement flow path C5 is used in the case of pulling out ink from the print head 8 in use such as at the time of replacement of the print head 8 or at the time of transportation of the printing apparatus 1. The head replacement valve V5 is controlled by the ink supply control unit 209 so as to be closed except for a case of filling ink in the print head 8 and a case of pulling out ink from the print head 8.

Next, a flow path configuration inside the print head 8 will be described. Ink supplied through the supply flow path C2 to the print head 8 passes through a filter 83 and is then supplied to a first negative pressure control unit 81 and a second negative pressure control unit 82. The first negative pressure control unit 81 has a control pressure set to a low negative pressure (negative pressure having a small pressure difference from atmospheric pressure). The second negative pressure control unit 82 has a control pressure set to a high negative pressure (negative pressure having a large pressure difference from atmospheric pressure). Pressures in those first negative pressure control unit 81 and second negative pressure control unit 82 are generated within an adequate range by the driving of the collection pump P2.

In an ink ejection unit 80, a plurality of printing element substrates 80*a* in each of which a plurality of ejection openings are arrayed are arranged to form an elongate ejection opening array. A common supply flow path 80*b* (IN flow path) for guiding ink supplied from the first negative pressure control unit 81 and a common collection flow path 80*c* (OUT flow path) for guiding ink supplied from the second negative pressure control unit 82 also extend in the direction of the array of the printing element substrates 80*a*. Furthermore, individual supply flow paths connected to the common supply flow path 80*b* and individual collection flow paths connected to the common collection flow path 80*c* are formed in each of the printing element substrates 80*a*. Accordingly, an ink flow is generated in each of the printing element substrates 80*a* such that ink flows in from the common supply flow path 80*b* which has relatively lower negative pressure and flows out to the common collection flow path 80*c* which has relatively higher negative pressure. A pressure chamber which communicates with each ejection opening and which is filled with ink is provided in the midstream of a path between the individual supply flow path and the individual collection flow path, so that an ink flow is generated even in the ejection opening and the pressure chamber where printing is not performed. Once the ejection operation is performed in the printing element substrate 80*a*, a part of ink moving from the common supply flow path 80*b* to the common collection flow path 80*c* is ejected from the ejection opening to be consumed; meanwhile, ink that has not been ejected moves toward the collection flow path C4 through the common collection flow path 80*c*.

Figure 7A:
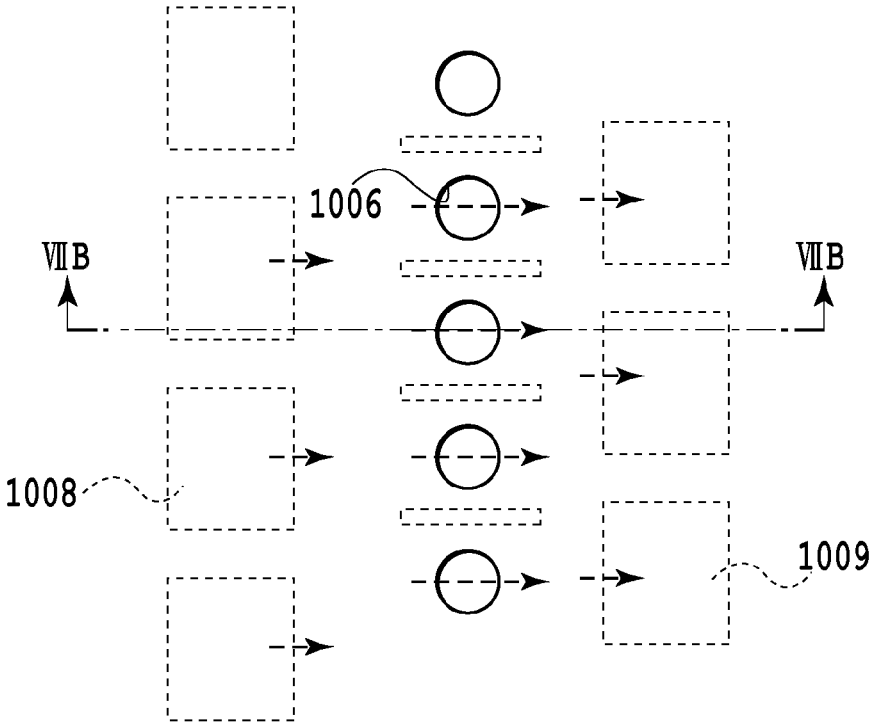
FIGS. 7A and 7B are diagrams illustrating an ejection opening and a pressure chamber.
Figure 7B:
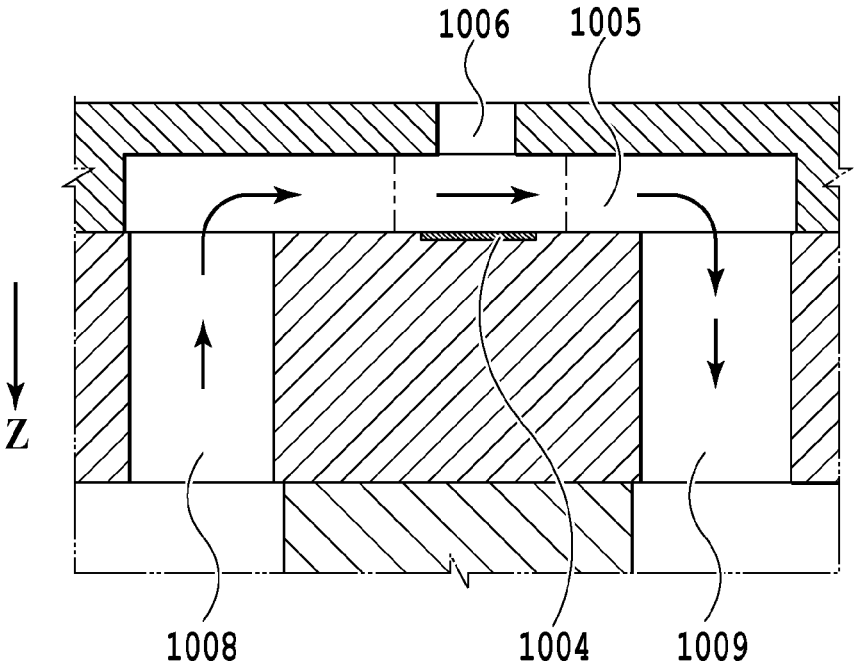

FIG. 7A is a plan schematic view showing in enlargement a part of the printing element substrate 80*a*, and FIG. 7B is a cross-sectional schematic view along line VIIB-VIIB in FIG. 7A. A pressure chamber 1005 which is filled with ink and an ejection opening 1006 from which ink is ejected are provided in the printing element substrate 80*a*. A printing element 1004 is provided in the pressure chamber 1005 at a position facing the ejection opening 1006. Further, in the printing element substrate 80*a*, a plurality of individual supply flow paths 1008 each of which is connected to the common supply flow path 80*b* and a plurality of individual collection flow paths 1009 each of which is connected to the common collection flow path 80*c* are formed for the respective ejection openings 1006.

The foregoing configuration generates, in the printing element substrate 80*a*, an ink flow such that ink flows in from the common supply flow path 80*b* which has relatively low negative pressure (whose absolute value is high) and flows out to the common collection flow path 80*c* which has relatively high negative pressure (whose absolute value is low). To be more specific, ink flows in the order of the common supply flow path 80*b*, the individual supply flow path 1008, the pressure chamber 1005, the individual collection flow path 1009, and the common collection flow path 80*c*. Once ink is ejected by the printing element 1004, part of ink moving from the common supply flow path 80*b* to the common collection flow path 80*c* is ejected from the ejection opening 1006 to be discharged outside the print head 8. Meanwhile, ink which has not been ejected from the ejection opening 1006 is collected into the collection flow path C4 through the common collection flow path 80*c*.

At a time of performing print operation, the ink supply control unit 209 closes the tank supply valve V1, the head replacement valve V5 and the sub-tank decompression valve V6, opens the atmosphere release valve V0, the supply valve V2, the collection valve V4, and the suction valve V8, and drives the supply pump P1 and the collection pump P2. As a result, a circulation path of the sub-tank 151, the supply flow path C2, the print head 8, the collection flow path C4, and the sub-tank 151 is established. In a case where the amount of ink supply per unit time from the supply pump P1 is larger than the total value of the ejection amount per unit time of the print head 8 and the flow rate per unit time in the collection pump P2, ink flows into the relief flow path C3 from the supply flow path C2. Accordingly, the flow rate of the ink flowing into the print head 8 from the supply flow path C2 is adjusted.

In a case where print operation is not performed, the ink supply control unit 209 stops the supply pump P1 and the collection pump P2 and closes the atmosphere release valve V0, the supply valve V2, and the collection valve V4. As a result, the flow of ink in the print head 8 is stopped, and the backflow due to the water head difference between the sub-tank 151 and the print head 8 is also suppressed. In addition, closing the atmosphere release valve V0 suppresses ink leakage and evaporation of ink from the sub-tank 151.

At the time of pulling out ink from the print head 8, the ink supply control unit 209 closes the atmosphere release valve V0, the tank supply valve V1, the supply valve V2, and the collection valve V4, opens the head replacement valve V5, and drives the vacuum pump P0. As a result, the interior of the sub-tank 151 goes into a negative pressure state, and the ink in the print head 8 is collected back to the sub-tank 151 through the head replacement flow path C5. As apparent from the above, the head replacement valve V5 is a valve which is closed during the normal print operation and in the standby state, and is opened at the time of pulling out ink from the print head 8. The head replacement valve V5 is also opened at the time of filling ink in the head replacement flow path C5 in filling ink in the print head 8.

(Arrangement Relation of Ink Supply Unit)

Figure 8:
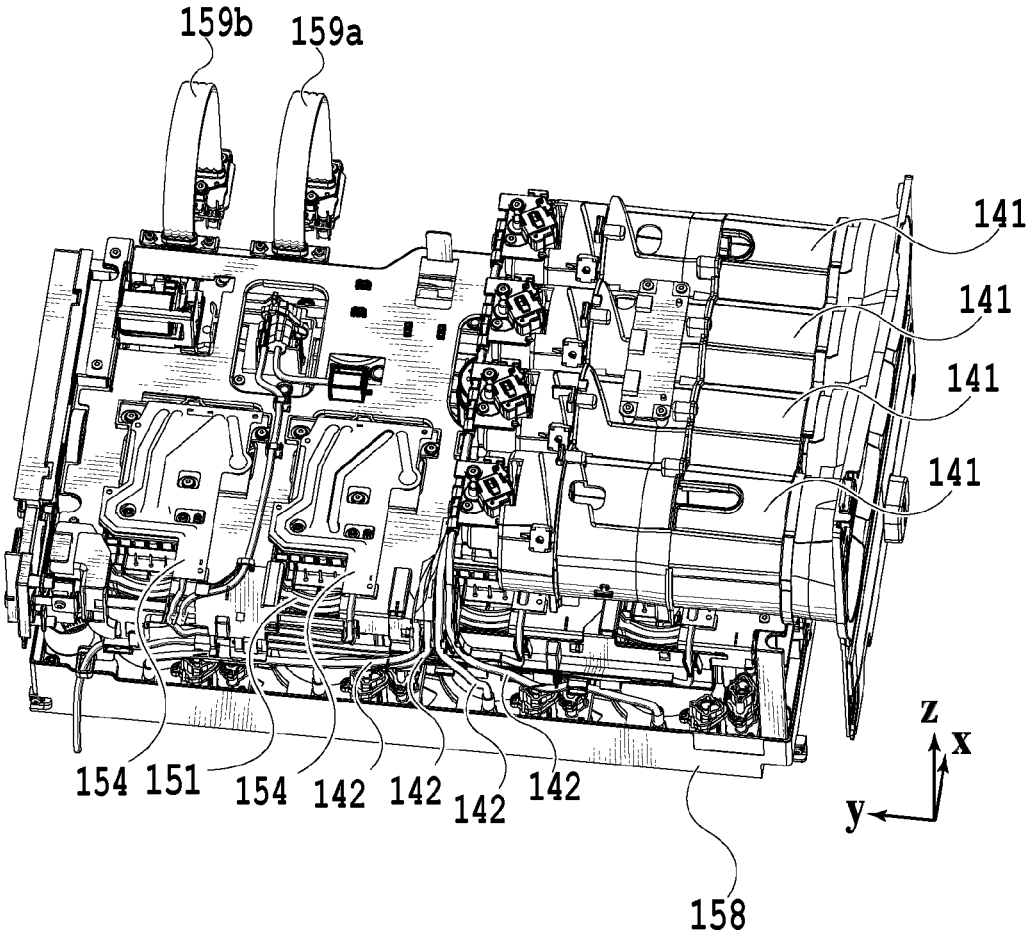
FIG. 8 is a perspective view of an ink tank unit and an ink supply unit.

FIG. 8 is a perspective view including the ink tank unit 14 and the ink supply unit 15. Ink is supplied from the main tank 141 of each color of the ink tank unit 14 to the ink supply unit 15 through the supply tube 142. That is, the tank connection flow path C1 for supplying ink from the main tank 141 to the sub-tank 151 is formed in the supply tube 142. As shown in FIG. 8, the ink supply unit 15 is disposed below the ink tank unit 14 in the gravitational direction. Hereinafter, in the case of simply referring to "upper" and "lower," it indicates upper and lower in the gravitational direction (z-direction). In the ink supply unit 15, a linkage tube 159 is provided for each of the supply flow path C2 and the collection flow path C4. In the linkage tube 159, flow paths are partitioned according to the inks of the individual colors. That is, the supply flow paths C2 corresponding to the individual colors are formed in one linkage tube 159, and the collection flow paths C4 corresponding to the individual colors are formed in the other linkage tubes 159. The linkage tubes 159 are connected to the print head 8 (not shown in FIG. 8). In FIG. 8, the atmosphere communication plate 154 is disposed above the ink supply unit 15.

Figure 9A:
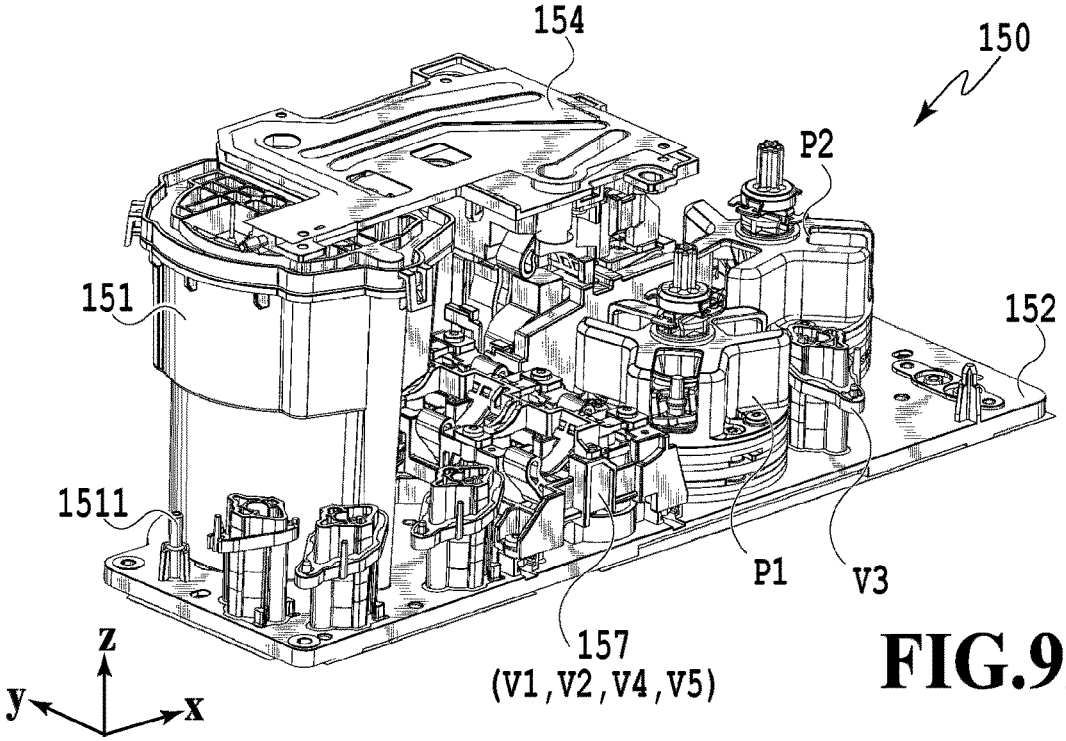
FIGS. 9A and 9B are perspective views of a subunit.
Figure 9B:
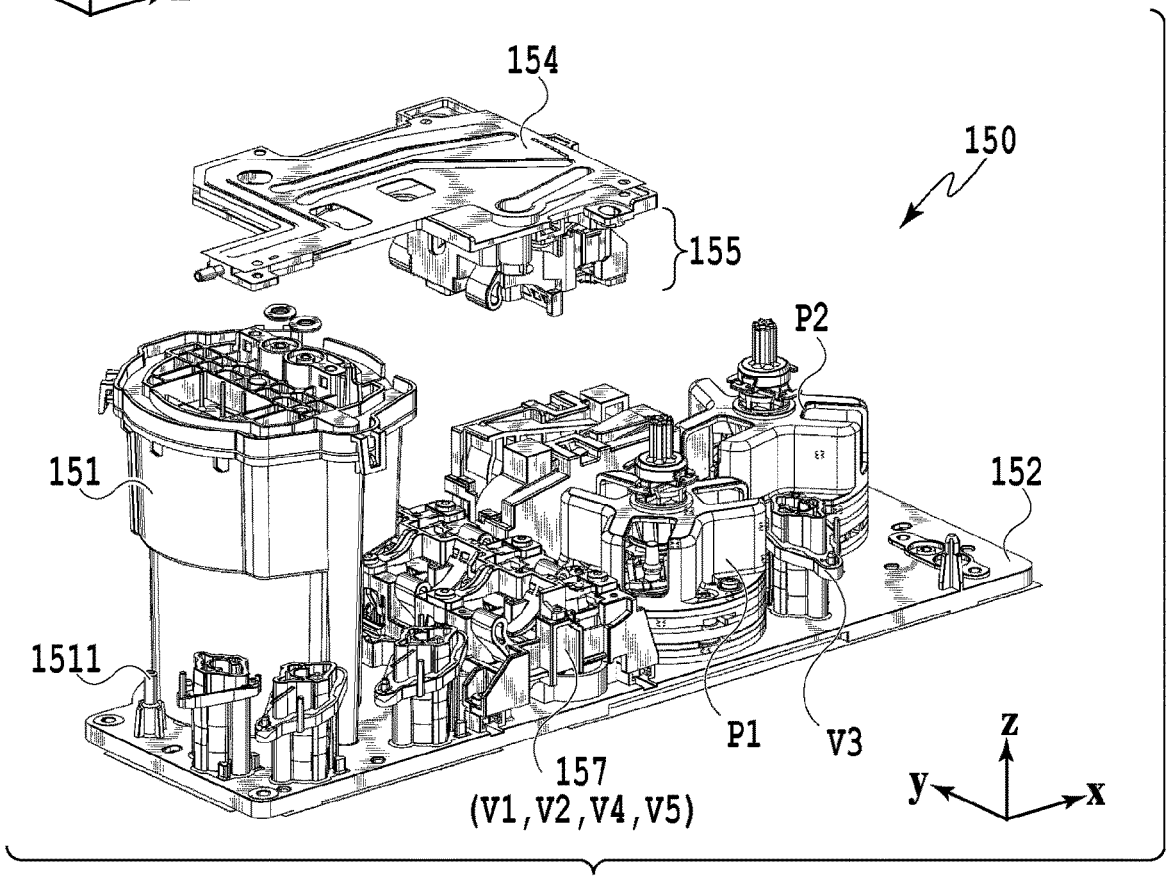

FIG. 9A is a perspective view of a subunit 150 constituting the ink supply unit 15. FIG. 9B is a perspective view of the state in which the atmosphere communication plate 154 of FIG. 9A is separated from the subunit 150. The subunit 150 is provided for each ink color. The figures show the subunit 150 corresponding to an arbitrary ink color. The subunit 150 includes a sub-tank 151, an ink flow path plate 152 disposed below the sub-tank 151, and an atmosphere communication plate 154 disposed above the sub-tank 151. A tube connecting portion 1511 for connecting the supply tube 142 (see FIG. 8) connected to the main tank 141 is disposed on the ink flow path plate 152. Ink is supplied to the sub-tank 151 through the tank connection flow path C1 formed in the ink flow path plate 152. The supply flow path C2 for supplying ink from the sub-tank 151 to the print head 8 and the collection flow path C4 for collecting ink from the print head 8 to the sub-tank 151 are formed in the ink flow path plate 152. The air flow path C0 through which air flows is formed in the atmosphere communication plate 154. In FIGS. 9A and 9B, the parts corresponding to the various valves and pumps illustrated in FIG. 6 are denoted by the same reference numerals as those in FIG. 6. The drive valves (tank supply valve V1, supply valve V2, collection valve V4, and head replacement valve V5) are disposed inside a lever holder 157.

Figure 10:
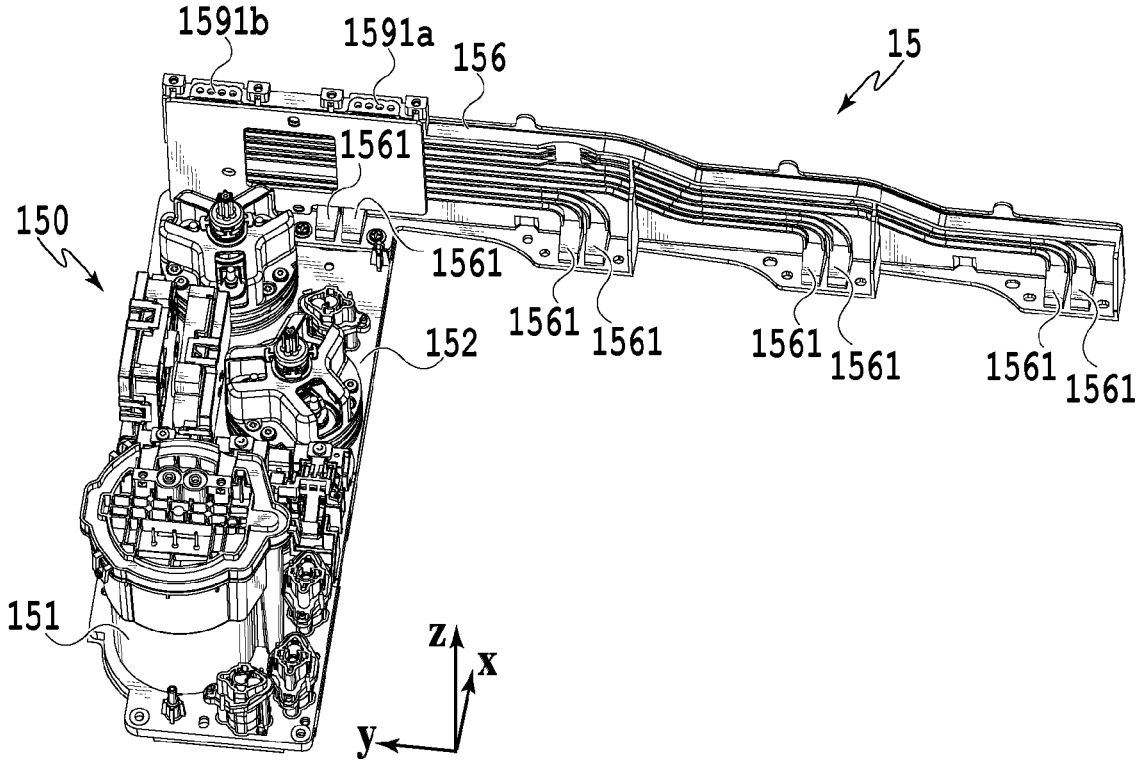
FIG. 10 is a perspective view of the ink supply unit.

FIG. 10 is a perspective view of the ink supply unit 15. The ink supply unit 15 further includes a flow path aggregation plate 156 in addition to the subunit 150 (only one subunit 150 for one color is shown in FIG. 10) for each ink color. In the present embodiment, the subunits 150 having the same arrangement and configuration are arranged in the same direction in the y-direction (horizontal direction).

The sub-tank 151 is disposed above substantially one end portion of the ink flow path plate 152. That is, a connecting portion between the sub-tank 151 and the ink flow path plate 152 (hereinafter referred to as first connecting portion) is provided on the bottom surface of the sub-tank 151. Flow paths (supply flow path C2 and collection flow path C4) are formed in the ink flow path plate 152 so as to extend in the horizontal direction (x-direction) from the first connection portion (immediately below the sub-tank) connected to the sub-tank 151. It is to be noted that the flow paths as a whole extend in the x-direction and may be guided in another direction halfway. As shown in FIG. 10, at an end portion on the opposite side in the x-direction of an end portion where the first connection portion 1512 of the ink flow path plate 152 is provided, a connecting portion for connecting the flow path inside the ink flow path plate 152 to the flow path aggregation plate 156 (hereinafter referred to as second connecting portion 1561) is provided.

The flow path aggregation plate 156 is disposed above the ink flow path plate 152 of each subunit 150 so as to traverse the second connecting portions 1561. A flow path for guiding the ink fed to each second connecting portion 1561 or the ink delivered from each second connecting portion 1561 in a substantially horizontal direction (y-direction) is formed in the flow path aggregation plate 156. As shown in FIG. 10, all the flow paths are arranged side by side in the z-direction in the flow path aggregation plate 156. The flow path aggregation plate 156 includes a third connecting portion 1591 to be connected to the linkage tube 159 (see FIG. 8).

In this manner, the supply flow path C2 and the collection flow path C4 are formed in the ink flow path plate 152, the flow path aggregation plate 156, and the linkage tube 159.

(Positional Configuration of Each Unit)

Figure 11:
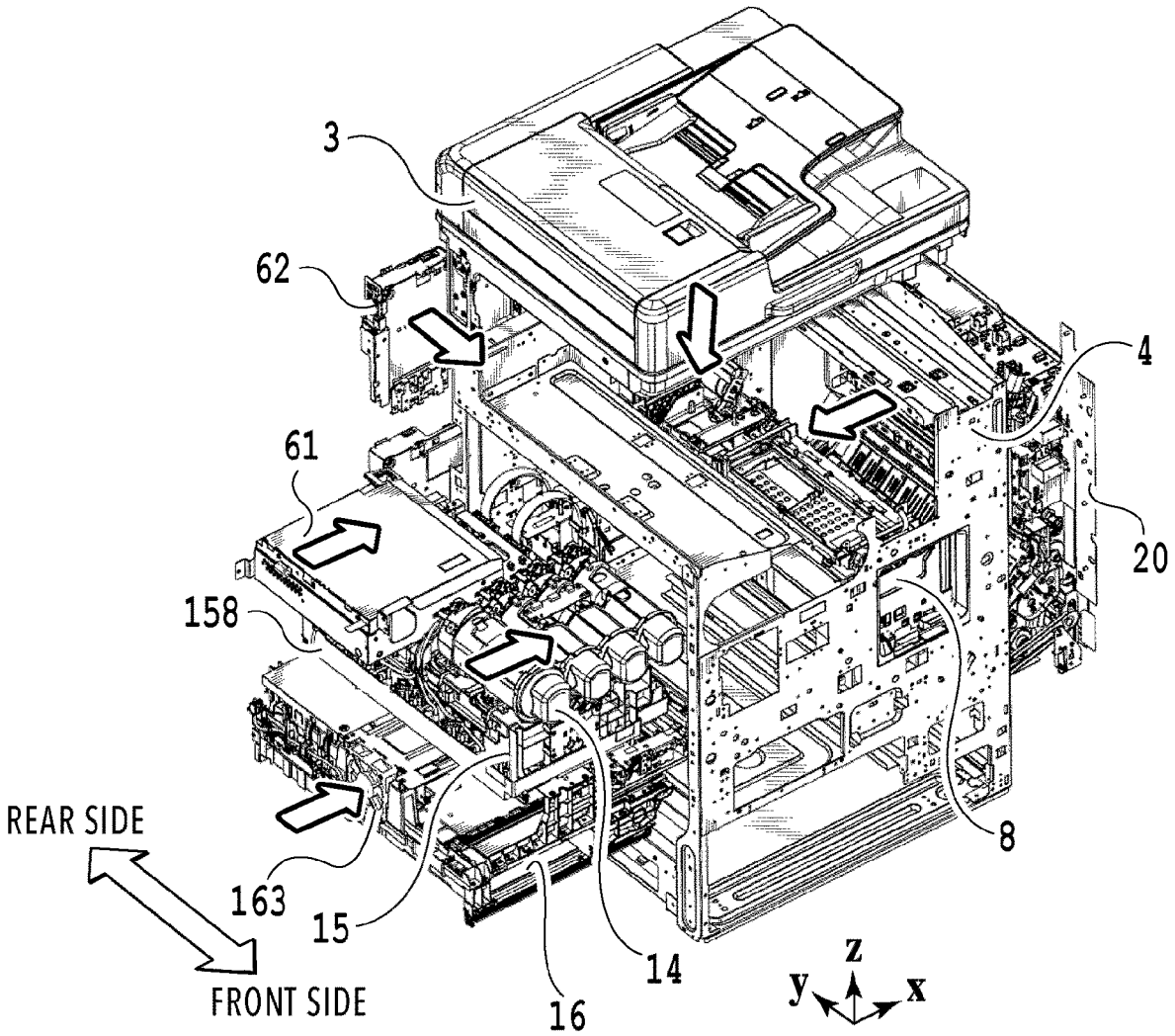
FIG. 11 is an exploded perspective view of the printing apparatus.

FIG. 11 is an exploded perspective view of the printing apparatus 1. The positional relationship between the units and the attaching and detaching direction of each unit will be described with reference to FIGS. 11 and 1. The near side of the printing apparatus 1 illustrated in FIG. 1 is called the front side, and the far side is called the rear side. The right side face of the printing apparatus 1 illustrated in FIG. 1 is called the right side-face side, and the left side face is called the left side-face side. As illustrated in FIG. 11, the scanner unit 3 is adapted to be attached on the top face of the casing 4 (the upper side in the gravitational direction). The conveying unit 20 is adapted to be attached from the right side-face side of the casing 4. The print head 8 is adapted to be attached from the front side of the casing 4 (already attached in FIG. 11). The maintenance unit 16 is adapted to be attached from the left side-face side of the casing 4. The ink supply unit 15 to which the ink tank unit 14 is adapted to be attached is adapted to be attached from the left side-face side of the casing 4. The ink tank unit 14 is adapted to be attached from the front side. A power supply unit 61 is adapted to be attached from the left side-face side of the casing 4. A printed wiring board 62 is adapted to be attached from the rear side of the casing 4. These units and the like are configured to be removable by the user. For example, the casing is provided with not-illustrated guide members, and each unit or the like can be attached to or removed from the casing 4 by sliding the unit on the guide members.

Each of these units and the like can be attached or removed separately from other units and the like. For example, in a case where a failure or the like occurs and a part in the conveying unit 20 needs to be replaced, the user can remove only the conveying unit 20 without removing other units (for example, the ink supply unit 15). The same is true of the other units and the like. The configuration in which each unit or the like can be attached and detached separately from other units and the like as described above improves serviceability for the case of replacing parts. In other words, since a unit of interest alone can be removed, only the unit in need can be quickly removed.

(Configuration for Air-cooling Ink)

Figure 12:
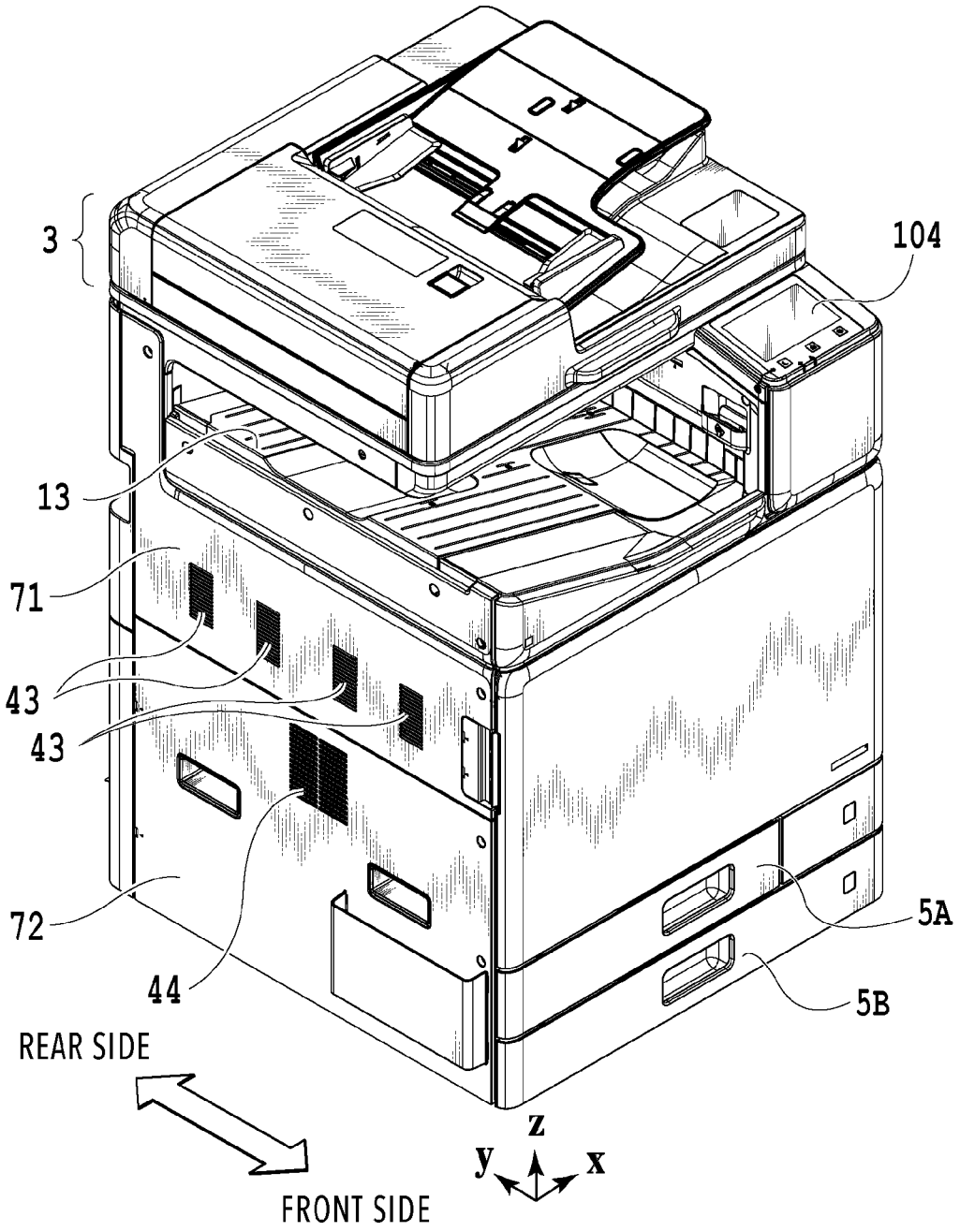
FIG. 12 is a perspective view of the outer appearance of the printing apparatus.

FIG. 12 is a perspective view of the outer appearance of the printing apparatus 1. In FIG. 12, each unit illustrated in FIG. 11 is attached to the apparatus, and housing covers also are attached to the apparatus. The configuration for air-cooling ink will be described with reference to FIGS. 12, 11, and 1. In the print head 8 of the present embodiment, ink is ejected by being heated. In addition, the printing apparatus 1 of the present embodiment has a configuration in which ink is circulated between the sub-tank 151 and the print head 8 as described earlier. Thus, ink not used for ejection, having heat, circulates in the circulation path. In a case where the temperature of circulating ink increases, water contained in the ink evaporates, leading to increase in the viscosity of the ink, or air inside the ink grows up to be bubbles, preventing proper ink ejection. To prevent this situation, the printing apparatus 1 of the present embodiment includes a configuration for cooling ink. In the following, a configuration for air-cooling ink will be described as an example of cooling ink.

A first housing cover 71 on the left side-face side of the printing apparatus 1 has first openings (herein after referred to as air supply openings 43). The first housing cover 71 is a housing portion for the ink supply unit 15. As illustrated in FIG. 12, four air supply openings 43 are formed in the first housing cover 71. As illustrated in FIG. 1, in the state in which the ink supply unit 15 is attached to the printing apparatus 1, the sub-tank 151 for each color is located on the left side-face side. Each air supply opening 43 is located at a position that faces the corresponding sub-tank 151 in the horizontal direction.

A second housing cover 72 on the left side-face side of the printing apparatus 1 has a second opening (hereinafter referred to as an air discharge opening 44). The second housing cover 72 is a housing portion of the maintenance unit 16. As illustrated in FIGS. 1 and 11, the maintenance unit 16 includes the air discharge fan 163. The air discharge opening 44 is formed at a position facing the air discharge fan 163 in the horizontal direction.

Next, the arrangement inside the main body of the printing apparatus will be described with reference to FIGS. 1 and 11. On the upper face of the maintenance unit 16 is disposed a tray 158 for the ink supply unit 15. On the front side and the rear side of the maintenance unit 16 are located the side faces of the casing 4. The air discharge fan 163 is located at a position approximately in the center in the y-direction of the maintenance unit 16. As illustrated in FIG. 5, although some members are included in the path from the air discharge fan 163 to the print head 8 in the horizontal direction, gaps (space) are formed inside the maintenance unit 16. In addition, there is also space between the maintenance unit 16 and the print head 8. As illustrated in FIGS. 1, 3, and 4, this space exists in the state in which the ejection opening surface 8*a* of the print head 8 is facing downward in the vertical direction and also in the state in which it is at 45 degrees from the vertical direction toward the horizontal direction. Thus, in the maintenance unit 16, an air passage is formed from the print head 8 to the air discharge fan 163 approximately in the horizontal direction.

The print head 8 is a full-line print head, which extends from the front side to the rear side. There is space on the maintenance unit 16 side (the ink supply unit 15 side) of the print head 8 both in the standby state illustrated in FIG. 1 and in the printing state illustrated in FIG. 3. Above the print head 8 is located the discharging tray 13 with a space in between. Below on the right side-face side of the print head 8 is located the conveying unit 20.

On the upper face of the ink supply unit 15 are located the ink tank unit 14 and the power supply unit 61. Above the ink tank unit 14 and the power supply unit 61 is located the discharging tray 13. On the front side and the rear side of the ink supply unit 15 are located the side faces of the casing 4. Adjoining to the left side-face side of the ink supply unit 15 are the air supply openings 43 of the first housing cover. As illustrated in FIGS. 8 to 10, although some members are included in the path from the ink supply unit 15 to the print head 8 in the horizontal direction, gaps (space) are formed inside the ink supply unit 15. In addition, there is also space between the ink supply unit 15 and the print head 8. As illustrated in FIGS. 1, 3, and 4, this space exists in the state in which the ejection opening surface 8*a* of the print head 8 is facing downward in the vertical direction and also in the state in which it is at 45 degrees from the vertical direction toward the horizontal direction. Thus, in the ink supply unit 15, an air passage is formed from the air supply opening 43 to the print head 8 approximately in the horizontal direction.

With this arrangement, driving of the air discharge fan 163 causes an air flow in which air (outside air) flows through the air supply openings 43 into the ink supply unit 15 and air inside the printing apparatus (inside air) is discharged through the air discharge opening 44 of the maintenance unit 16. The heat exchange between circulating ink and air dissipates heat from the ink, thus the ink is air-cooled.

Figure 13:
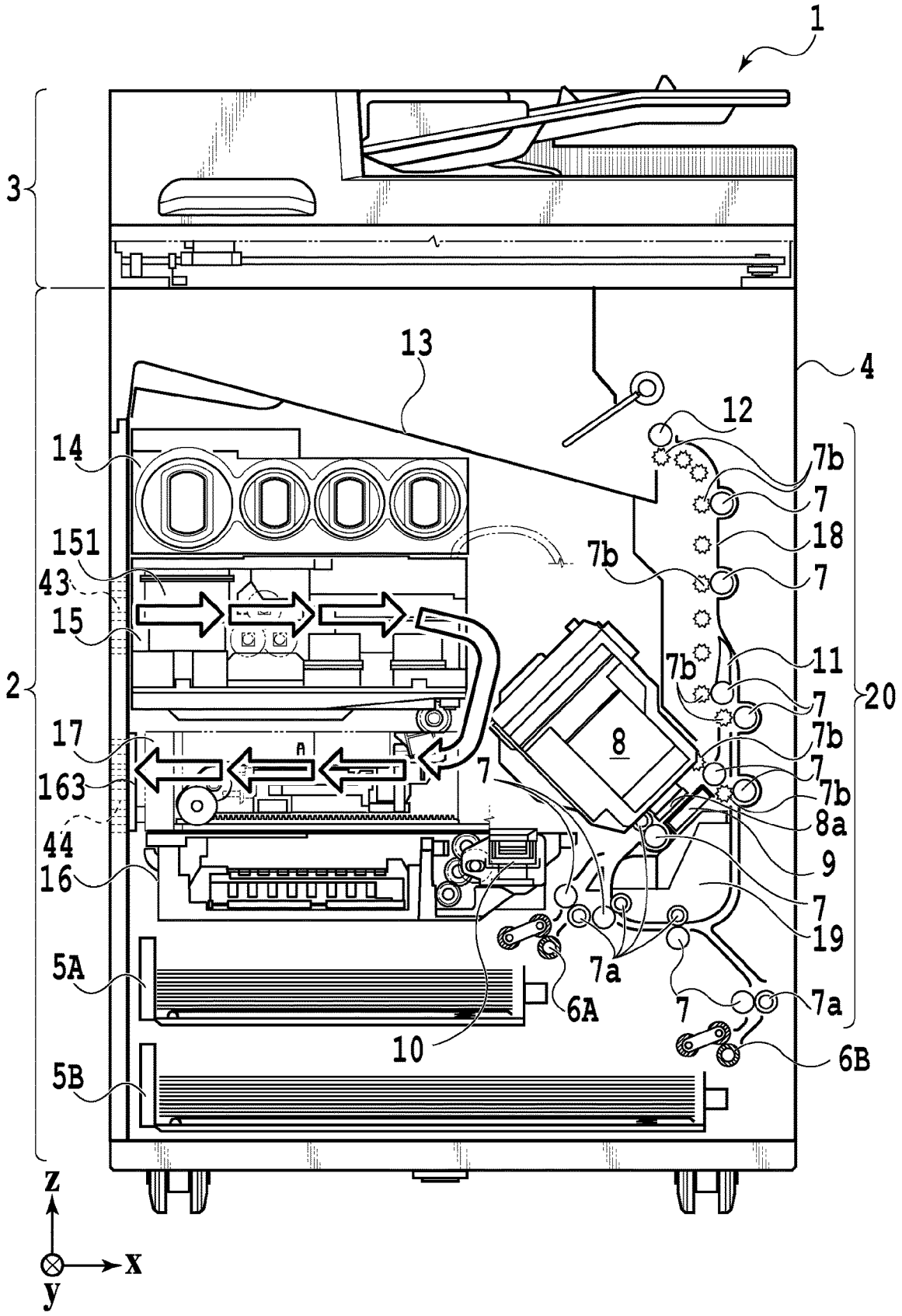
FIG. 13 is a diagram illustrating air flow.
Figure 14:
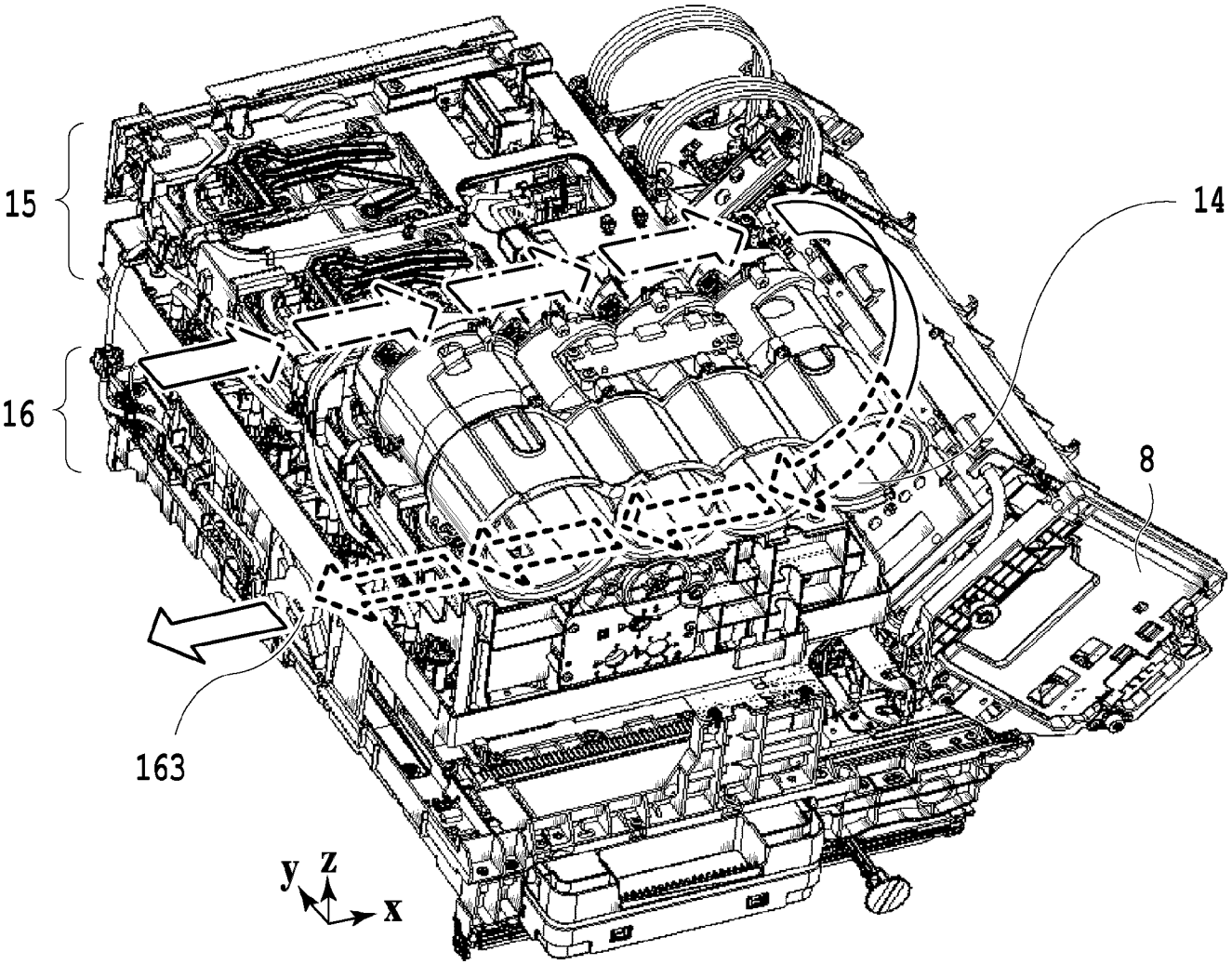
FIG. 14 is a diagram illustrating air flow.

FIGS. 13 and 14 are diagrams illustrating the air flow. FIG. 13 is a diagram in which arrows indicating the air flow are added to the cross-sectional view of FIG. 3. FIG. 14 is a diagram in which arrows indicating the air flow are added to a perspective view of the ink supply unit 15, ink tank unit 14, and print head 8 that are extracted.

The main controller 101 performs control to drive the air discharge fan 163. Note that a not-illustrated fan control unit may perform control to drive the air discharge fan 163. The printing apparatus 1 has a not-illustrated temperature sensor inside the main body, and in a case where the temperature inside the main body reaches a specified temperature, the air discharge fan 163 is driven. Alternatively, a temperature sensor may be disposed at a certain position in the circulation path, and the air discharge fan 163 may be driven in a case where the temperature of ink reaches a specified temperature. Further, the air discharge fan 163 may be driven based on the outputs of both temperature sensors.

In the case where the air discharge fan 163 is driven, negative pressure is generated inside the main body of the printing apparatus 1, causing air to flow through the air supply openings 43 into the main body. Inflowing air passes inside the ink supply unit 15. To be more specific, the air flowing in through the air supply opening 43 first hits the sub-tank 151. Then, inflowing air moves inside the ink supply unit 15 toward the print head 8. After the inflowing air hits the print head 8, it follows the air flow caused by the air discharge fan 163 and moves downward along the print head 8 using it as a wall. Then, the air that has moved downward moves inside the maintenance unit 16 toward the air discharge fan 163, following the air flow caused by the air discharge fan 163 and is discharged through the air discharge opening 44. In summary, as illustrated in FIGS. 13 and 14, the air flow in the shape of a lying letter U is generated.

The present embodiment includes four air supply openings 43 as illustrated in FIG. 12. The sub-tank 151 for each ink is located at a position adjoining an air supply opening 43. In other words, each sub-tank 151 faces the corresponding opening (air supply opening 43) of the first housing cover 71. Thus, outside air flowing in through each air supply opening 43 first hits the sub-tank 151 of the corresponding ink. The sub-tank 151 contains collected ink that has circulated and thus is a place where ink having heat gathers. Generally, outside air flowing in through the air supply openings 43 is colder than the air inside the main body of the printing apparatus 1. Since cold outside air first hits (is directly blown to) the sub-tanks 151 where the ink circulating in the circulation path, in other words, ink having heat is collected as described above, it is possible to cool the circulating ink efficiently.

As described with reference to FIGS. 8 to 10, the flow path in which ink circulates is formed to extend approximately from the sub-tanks 151 toward the print head 8. Thus, since the air flowing in through the air supply openings 43 moves along the flow path in which ink circulates toward the print head 8, it is possible to provide the heat dissipation effect not only for the ink inside the sub-tanks 151 but also for the ink circulating in the supply flow path C2 and the collection flow path C4.

Figure 15A:
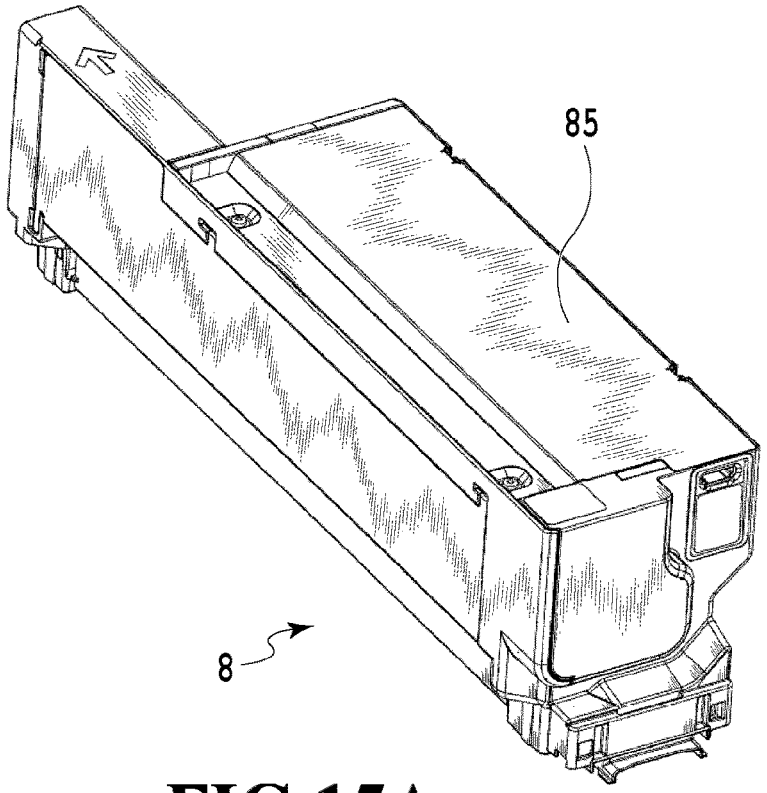
FIGS. 15A and 15B are perspective views of the print head.
Figure 15B:
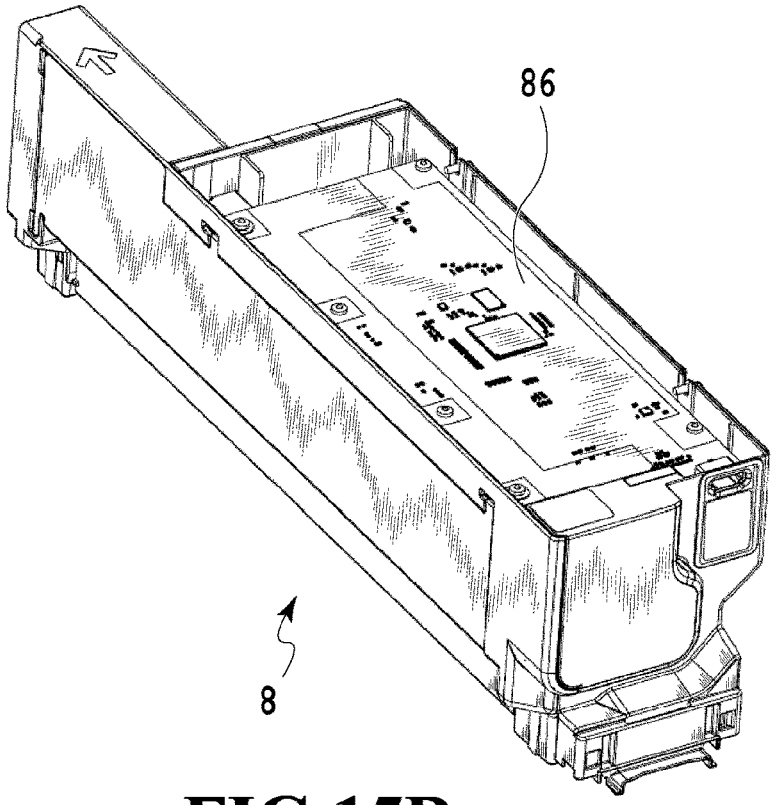

FIGS. 15A and 15B are perspective views of the print head 8. As illustrated in FIG. 15A, the print head 8 includes a cover 85 on the top face. FIG. 15B is a diagram illustrating the print head 8 with the cover 85 removed. The print head 8 includes a control board 86. The control board 86 has various electronic devices for controlling ink ejection of the print head 8. Since air flows along the print head 8 using it as a wall toward below the print head 8 as illustrated in FIGS. 13 and 14, the air flow also provides the heat dissipation effect for the control board 86 that controls ink ejection of the print head 8. Further, as described with reference to FIG. 11, the power supply unit 61 is located on the ink supply unit 15. The air flowing in through the air supply openings 43 also provides the heat dissipation effect for the power supply unit 61 while the air is passing through the ink supply unit 15.

Note that although the air flow has been described with reference to FIGS. 13 and 14 based on an example for the case where the print head 8 is in the printing state, the same is true of the cases where the print head 8 is in the standby state illustrated in FIG. 1 and where it is in the maintenance state illustrated in FIG. 4. As described earlier, the air discharge fan 163 is driven regardless of the state of the print head 8.

As has been described above, the present embodiment is capable of air-cooling the entire circulating ink. Specifically, cooling the sub-tanks 151 where ink having heat is collected cools circulating ink efficiently, and the recirculation of the cooled ink cools the circulating ink in whole. In addition, the air flowing along the flow path in which ink circulates cools also the ink circulating in the supply flow path C2 and the collection flow path C4. In other words, the air flow air-cools the entire circulating ink.

The present embodiment has been described based on an example of a configuration including the blower (the air discharge fan 163) for discharging air and openings for supplying air. Use of an air discharge fan as a blower is preferable because a path for discharging air can be clearly defined. However, the present invention is not limited to this example. For example, a blower for supplying air may be used instead of the air supply openings 43. Also in this case, the entire circulating ink can be air-cooled.

Further, as another embodiment, an air discharge fan may be disposed between the air supply openings 43 and the sub-tanks 151 instead of the air discharge fan 163 included in the maintenance unit 16. Further, alternatively, a blower for supplying air may be used instead of the air discharge fan 163. Specifically, the air flow may be formed such that air first flows into the maintenance unit 16, then moves upward at the print head 8, passes through the ink supply unit 15, and is discharged. In this case, since air used to dissipate heat inside the main body and thus hotter than outside air hits the sub-tanks 151, the heat dissipation effect for the sub-tanks 151 is smaller than in the example described with reference to FIGS. 13 and 14. However, the same is true of this configuration in that air flows along the circulation flow path and thus this configuration is also capable of cooling circulating ink in whole.

In addition, although in the example of the present embodiment described, members on the ink supply unit 15 are arranged such that the sub-tanks 151 are located at positions adjoining to the air supply openings 43 in the state in which the ink supply unit 15 is attached to the printing apparatus 1, the present invention is not limited to this arrangement. The sub-tanks 151 may be arranged to be closer to the print head 8, in other words, closer to the flow path aggregation plate 156 (see FIG. 10). In addition, a member of the ink supply unit 15 may be between the air supply opening 43 and the sub-tank 151. In either case, the air flowing in through the air supply openings 43 will have heat dissipation effect for the sub-tank 151.

(Housing Cover)

Figure 16:
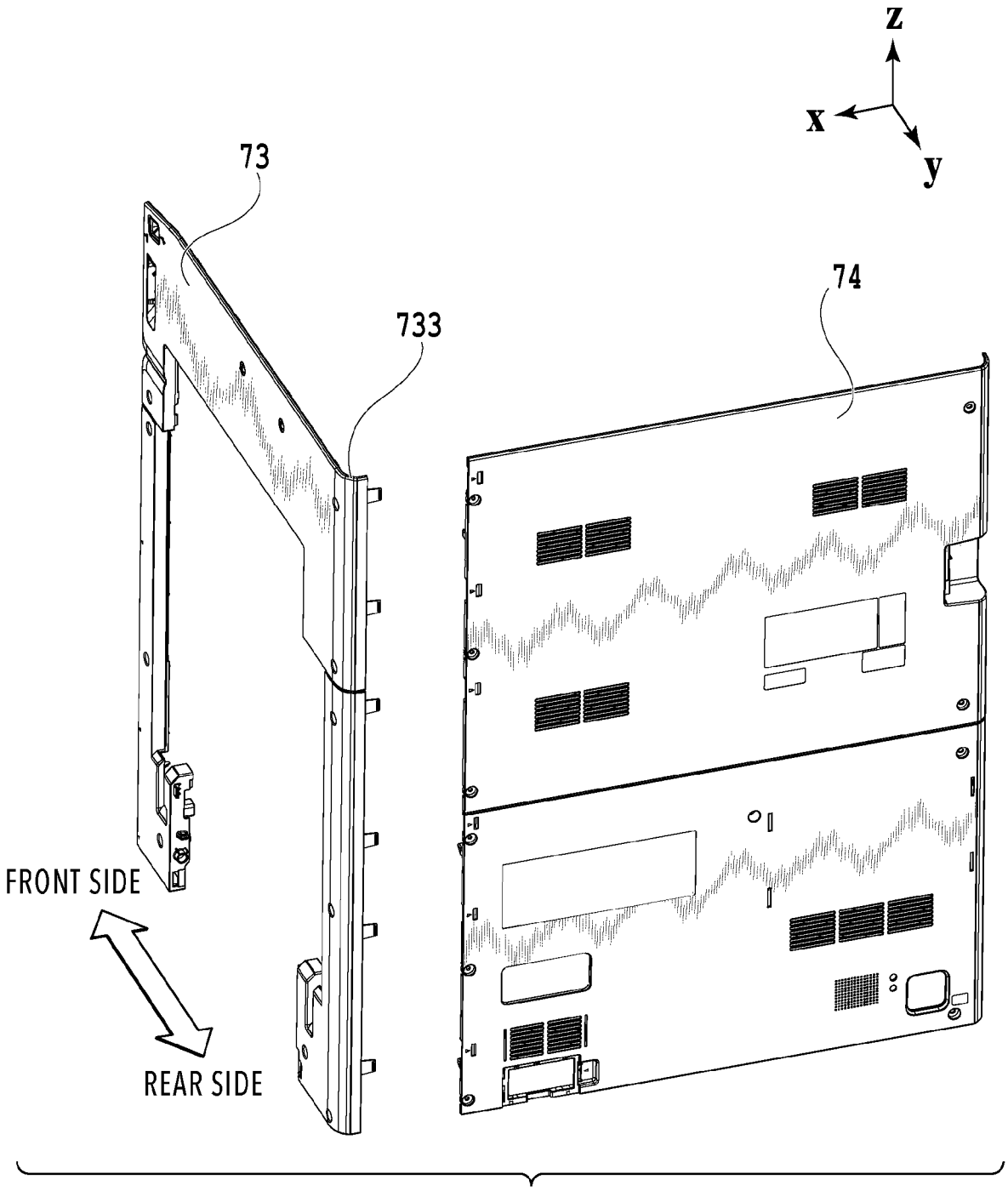
FIG. 16 is a diagram illustrating housing covers.

FIG. 16 is a diagram illustrating a third housing cover 73 and a fourth housing cover 74. The third housing cover 73 is a housing cover on the right side-face side (on the side from which the conveying unit 20 is attached) of the printing apparatus 1. The fourth housing cover 74 is a housing cover on the rear side of the printing apparatus 1. In the following, the configuration in which the housing covers are attached to the printing apparatus 1 will be described.

The housing cover serves as a function that improves the design of the outer appearance and keeps the inside of the main body of the printing apparatus 1 as a closed space. Here, keeping the inside of the main body as a closed space means hiding the inside of the main body including the casing 4 from the outside. To keep the inside of the main body of the printing apparatus 1 as a closed space, the connecting portions of the covers for the front side, the rear side, the right side-face side, and the left side-face side should preferably be overlapped with one another. Here, in a case where overlapped areas are large, in the event of attaching the housing covers to the main body of the apparatus, screws are fastened such that the screws pass through two adjoining housing covers. In this case, in a case where, for example, the first housing cover needs to be removed, the second housing cover also needs to be removed, which is extra work.

The housing covers in the present embodiment each have areas that overlap with adjoining housing covers and are configured such that a housing cover to be removed can be removed alone from the casing 4 of the printing apparatus 1. In other words, a housing cover can be removed separately without removing an adjoining housing cover from the casing 4.

The printing apparatus 1 of the present embodiment is configured such that each unit alone can be removed, as described with reference to FIG. 11. In addition, each housing cover alone can be removed. Thus, in the case where there is a need for replacing a unit, the user can replace it by only removing the unit to be replaced and the corresponding housing cover. This improves serviceability at the time of repairing.

Figure 17A:
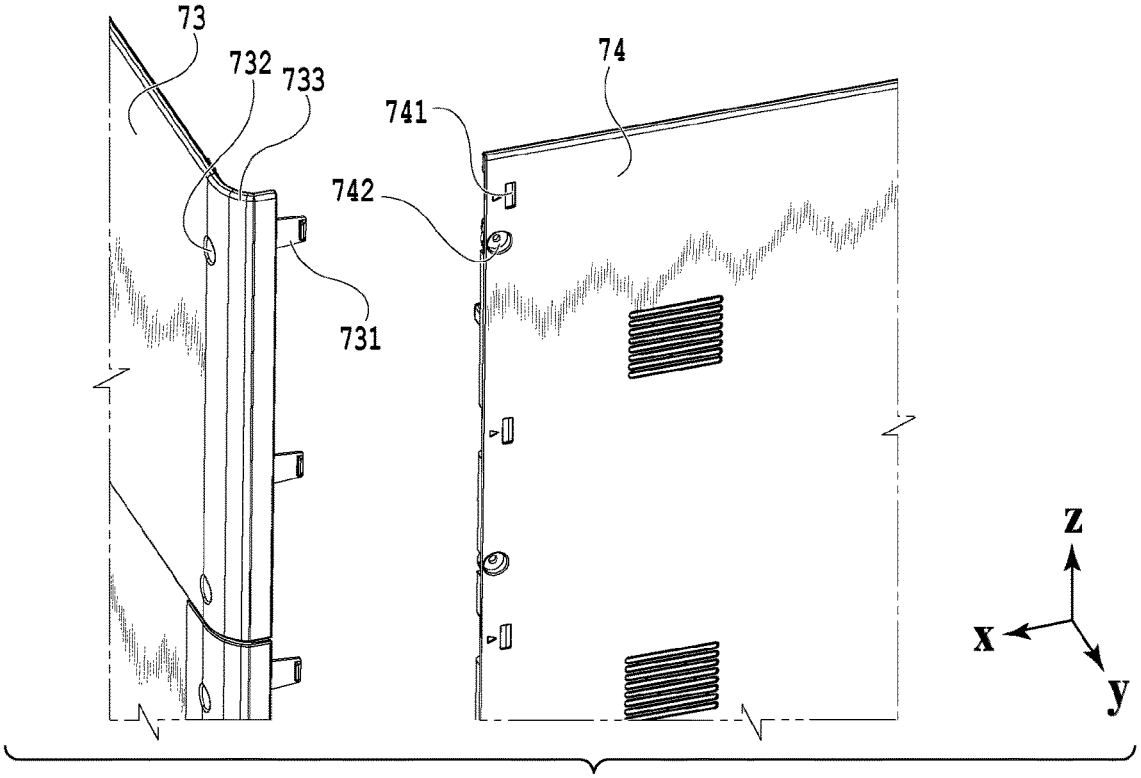
FIGS. 17A and 17B are enlarged views of the housing covers.
Figure 17B:
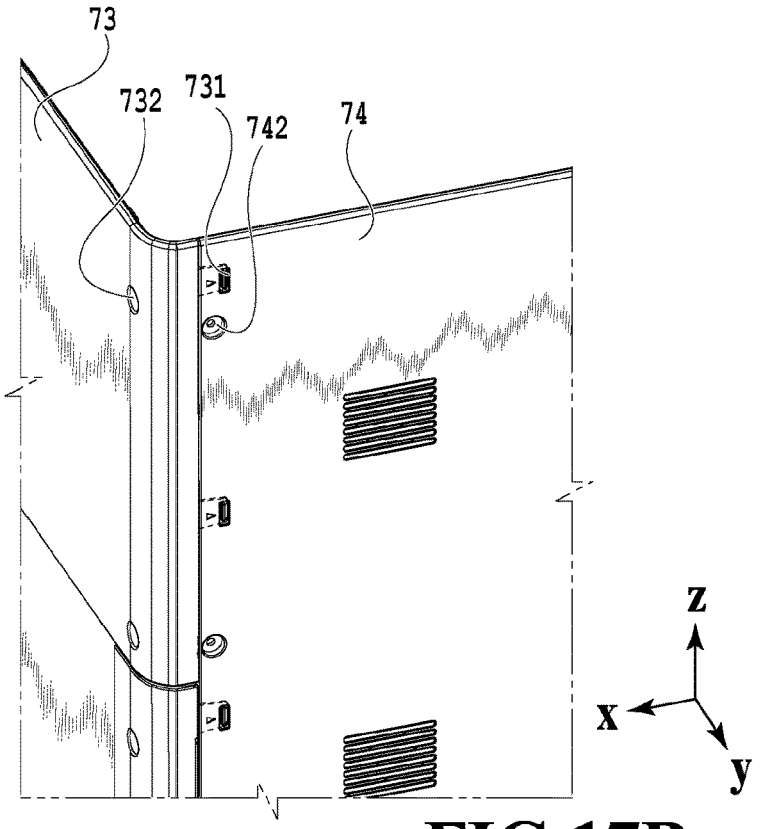

FIG. 17A and FIG. 17B are enlarged views of the third housing cover 73 and the fourth housing cover 74 illustrated in FIG. 16. FIG. 17A illustrates the third housing cover 73 and the fourth housing cover 74 before the third housing cover 73 is attached to the fourth housing cover 74 (and the casing 4, which is not illustrated in FIG. 17A). FIG. 17B illustrates the third housing cover 73 and the fourth housing cover 74 after the third housing cover 73 is attached to the fourth housing cover 74 (and the casing 4, which is not illustrated in FIG. 17B).

As illustrated in FIGS. 16, 17A, and 17B, the third housing cover 73 has a curved portion 733 at its one end that adjoins another housing cover (on the fourth housing cover 74 side). The curved portion 733 has hooks 731 (protrusions) at its extremity. In addition, the third housing cover 73 has screw holes 732. The casing to which the third housing cover 73 is attached also has screw holes (not illustrated in FIGS. 16, 17A, and 17B), and thus, the third housing cover 73 is attached to the casing 4 by fastening screws.

The fourth housing cover 74 has screw holes 742 and hook holes 741 (openings) at its one end that adjoins another housing cover (on the third housing cover 73 side). In the situation in which the fourth housing cover 74 and the third housing cover 73 are attached to the casing 4, the curved portion 733 of the third housing cover 73 is not overlapped with the fourth housing cover 74 in the x-direction. In that situation, the hooks 731 protruding from the curved portion 733 in the x-direction are fitted into the hook holes 741 of the fourth housing cover 74. In other words, only the hooks 731 of the third housing cover 73 are overlapped with the fourth housing cover 74 in the x-direction.

The fitting of the hooks 731 into the hook holes 741 as described above couples the third housing cover 73 and the fourth housing cover 74 to each other. The fitting of the hooks 731 into the hook holes 741 prevents the housing cover from lifting up, thus keeping the closed space. The overlapped portions between the two housing covers are only the hooks 731. Thus, in the situation in which screws are fastened through the screw holes 732 and 742, the screws do not need to pass through multiple housing covers. For this reason, in the case where a certain housing cover (for example, the third housing cover 73) needs to be removed, the certain housing cover can be released from the coupling state with another housing cover (the fourth housing cover 74) by disengaging the hooks 731 from the hook holes 741, without removing the other housing cover from the casing 4. Since the hooks 731 are fitted into the hook holes 741, the hook holes 741 are covered with the hooks 731, keeping the inside of the main body as a closed space.

Although FIGS. 16, 17A, and 17B illustrate the third housing cover 73 and the fourth housing cover 74 as an example, the same is true of the housing covers on the front side and the left side-face side. The number of illustrated hooks and hook holes is a mere example, and the present invention is not limited to this number.

Note that although in the present embodiment, a configuration including the ink supply unit 15, sub-tanks 151, supply flow path C2, collection flow path C4, supply pump P1, and collection pump P2, as described with reference to FIG. 6, has been described as an example, the present invention is not limited to this example. To achieve the ease of removing the housing covers, described above, does not necessarily require the circulative ink supply unit as described with reference to FIG. 6. For example, the ink supply unit may be one that supplies ink when it is necessary to supply ink from the tank to the print head.

Modification

Described in the embodiment described above are the following modifications.

Modification 1

A printing apparatus including:

a print head configured to eject ink;

an ink supply unit including a tank configured to contain ink to be ejected by the print head, a supply flow path through which liquid is supplied from the tank to the print head, a collection flow path through which liquid is collected from the print head to the tank, and a circulation unit configured to circulate ink inside a circulation flow path including the tank, the supply flow path, the print head, and the collection flow path; and a conveying unit configured to convey a print medium on which the print head performs printing, in which the ink supply unit is removable from a first side, and the conveying unit is removable from a second side, which is different from the first side.

Modification 2

The printing apparatus according to modification 1, further including a first cover that covers the ink supply unit or the conveying unit; and a second cover, in which the first cover has a curved portion at one end of the first cover in a horizontal direction, the curved portion having a protrusion at an extremity of the curved portion, and the second cover adjoins the first cover on the curved portion side, and the second cover has an opening into which the protrusion fits.

Modification 3

The printing apparatus according to modification 2, in which in a state where the first cover and the second cover are attached to a casing of the printing apparatus, the curved portion and the second cover are not overlapped with each other on the casing, but the protrusion and the second cover are overlapped with each other on the casing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-151457, filed Aug. 10, 2018, which is hereby incorporated by reference wherein in its entirety.

The invention claimed is:

1. A printing apparatus comprising:

a tank configured to contain liquid to be supplied through a flow path to a print head which ejects the liquid;

a circulation unit configured to circulate the liquid inside a circulation path including the flow path;

a suction unit configured to suck air from an intake port provided adjacent to the tank; and an exhaust port configured to exhaust air sucked by the suction unit from the printing apparatus, the exhaust port being provided below the intake port, wherein the intake port and the exhaust port are arranged in a same face of the printing apparatus.

2. The printing apparatus according to claim 1, wherein the intake port faces the tank.

3. The printing apparatus according to claim 1, wherein, in a state where the suction unit is driven, air sucked from the intake port flows through the tank and the print head.

4. The printing apparatus according to claim 3, wherein the print head includes a control board configured to control ejection form the print head.

5. The printing apparatus according to claim 4, wherein, in a state where the suction unit is driven, air sucked form the intake port flows through the tank and the control board.

6. The printing apparatus according to claim 1, further comprising:

a supply path configured to supply the liquid from the tank to the print head; and a collection path configured to collect the liquid from the print head to the tank;

wherein the circulation path includes the supply path and the collection path.

7. The printing apparatus according to claim 6, wherein, in a state where the suction unit is driven, air sucked form the intake port flows through the circulation path.

8. The printing apparatus according to claim 1, wherein the print head includes ejection openings arranged in an area corresponding to a width of a print medium.

9. The printing apparatus according to claim 1, wherein the circulation unit circulates the liquid inside the circulation path including the flow path and the print head.

10. The printing apparatus according to claim 9, wherein the print head includes at least one ejection opening, a printing element for generating energy used for ejecting ink corresponding to the ejection opening, and a pressure chamber which is an area facing to the printing element, the ejection opening ejecting ink supplied in the pressure chamber, and the circulation unit circulates the liquid inside the circulation path including the flow path and the pressure chamber of the print head.

11. The printing apparatus according to claim 1, wherein the circulation unit circulates the liquid inside the circulation path including the flow path and the tank.

12. A printing apparatus comprising:

a tank configured to contain liquid to be supplied through a flow path to a print head which ejects the liquid;

a circulation unit configured to circulate the liquid inside a circulation path including the flow path;

a blower configured to cool the tank; and a cover provided with an exhaust port and an intake port, wherein the blower sucks air from the intake port and exhausts air from the exhaust port, and the intake port and the exhaust port are arranged in a same face of the printing apparatus.

13. The printing apparatus according to claim 12, wherein the cover includes a first cover and a second cover, the first cover is provided with the intake port, and the second cover is provided with the exhaust port.

14. The printing apparatus according to claim 12, wherein the circulation unit circulates the liquid inside the circulation path including the flow path and the print head.

15. The printing apparatus according to claim 14, wherein the print head includes at least one ejection opening, a printing element for generating energy used for ejecting ink corresponding to the ejection opening, and a pressure chamber which is an area facing to the printing element, the ejection opening ejecting ink supplied in the pressure chamber, and the circulation unit circulates the liquid inside the circulation path including the flow path and the pressure chamber of the print head.

16. The printing apparatus according to claim 1, wherein the tank is disposed on a plate, and the plate is provided below the intake port and above the exhaust port.

17. The printing apparatus according to claim 1, further comprising:

a cover constituting a casing that covers the tank and provided with the intake port and the exhaust port.

18. The printing apparatus according to claim 12, wherein the tank is disposed on a plate, and the plate is provided below the intake port and above the exhaust port.

19. The printing apparatus according to claim 12, wherein the cover constitutes a casing that covers the tank.

* * * * *